US011529671B2

(12) United States Patent
Miura et al.

(10) Patent No.: US 11,529,671 B2
(45) Date of Patent: Dec. 20, 2022

(54) FORGING TOOL

(71) Applicants: NGK INSULATORS, LTD., Nagoya (JP); Hiromi Miura, Toyohashi (JP)

(72) Inventors: Hiromi Miura, Toyohashi (JP); Naokuni Muramatsu, Nagoya (JP); Tadahiro Kawamoto, Takasago (JP)

(73) Assignees: NGK Insulators, Ltd., Nagoya (JP); Hiromi Miura, Toyohashi (JP)

( * ) Notice: Subject to any disclaimer, the term of this patent is extended or adjusted under 35 U.S.C. 154(b) by 65 days.

(21) Appl. No.: 17/026,520

(22) Filed: Sep. 21, 2020

(65) Prior Publication Data

US 2021/0001391 A1 Jan. 7, 2021

Related U.S. Application Data

(63) Continuation of application No. PCT/JP2019/013686, filed on Mar. 28, 2019.

(30) Foreign Application Priority Data

Mar. 28, 2018 (JP) ..... JP2018-062494

(51) Int. Cl.
*B21J 9/02* (2006.01)
*B21J 13/02* (2006.01)

(52) U.S. Cl.
CPC *B21J 9/02* (2013.01); *B21J 13/02* (2013.01)

(58) Field of Classification Search
CPC ..... B21J 1/02; B21J 1/025; B21J 5/02; B21J 5/025; B21J 9/02; B21J 9/027; B21J 13/02; B21J 13/025; B30B 11/007; B22F 2003/031
See application file for complete search history.

(56) References Cited

U.S. PATENT DOCUMENTS 2,526,489 A * 10/1950 Liddicoat ..... B21J 13/025 72/344
3,045,515 A * 7/1962 Kralowetz ..... B21J 13/02 72/402
3,134,139 A * 5/1964 Wentorf, Jr. ..... B30B 11/007 264/319

(Continued)

FOREIGN PATENT DOCUMENTS

DE 4315464 A1 * 8/1994 ..... B30B 11/007
JP S64-022435 A1 1/1989

(Continued)

OTHER PUBLICATIONS

International Search Report and Written Opinion (Application No. PCT/JP2019/013686) dated Jun. 18, 2019.

(Continued)

*Primary Examiner* — Edward T Tolan
(74) *Attorney, Agent, or Firm* — Burr & Brown, PLLC

(57) ABSTRACT

A forging tool used to forge a workpiece in a cuboidal forging space, wherein (a): the forging space is formed when the bottom surface of the first die and the bottom surface of the second die are brought into contact with the contact surface of the third die, or (b): the forging space is formed when a first die contact surface provided in the first die and a second die contact surface provided in the second die are brought into contact with each other.

16 Claims, 16 Drawing Sheets

(56) References Cited

U.S. PATENT DOCUMENTS

| | | | | | |
|---|---|---|---|---|---|
| 3,159,876 | A | * | 12/1964 | Hall | B30B 15/04 100/232 |
| 3,406,555 | A | * | 10/1968 | Fuchs, Jr. | B21K 1/76 72/356 |
| 3,947,541 | A | * | 3/1976 | Barnes | B30B 11/007 425/DIG. 26 |
| 4,721,537 | A | | 1/1988 | Ghosh | |
| 4,996,863 | A | * | 3/1991 | Keeler | B21J 13/025 72/353.2 |
| 9,815,117 | B2 | * | 11/2017 | Yamashita | B30B 11/02 |
| 10,315,253 | B2 | * | 6/2019 | Schwarz | B30B 15/302 |
| 2010/0329923 | A1 | | 12/2010 | Muramatsu | |
| 2014/0366604 | A1 | | 12/2014 | Miura et al. | |
| 2016/0059294 | A1 | | 3/2016 | Yamashita | |
| 2017/0342537 | A1 | | 11/2017 | Lee et al. | |

FOREIGN PATENT DOCUMENTS

| | | | | | |
|---|---|---|---|---|---|
| JP | 09-276972 | A | * | 10/1997 | B21J 1/025 |
| JP | 2006-116592 | A1 | | 5/2006 | |
| JP | 6168090 | B2 | | 7/2017 | |
| WO | 2009/119237 | A1 | | 10/2009 | |
| WO | 2013/146309 | A1 | | 10/2013 | |

OTHER PUBLICATIONS

English translation of International Preliminary Report on Patentability (Chapter I) (Application No. PCT/JP2019/013686) 7 pages, dated Oct. 8, 2020.

Extended European Search Report (Application No. 19774396.6) dated Nov. 26, 2021.

* cited by examiner

FORGING TOOL

BACKGROUND OF THE INVENTION

1. Field of the Invention

The present invention relates to a forging tool.

2. Description of the Related Art

As the related art, so-called multi-axis forging is known in which plastic strain is sequentially added in the X, Y, Z axis directions of the workpiece perpendicular to each other by forging to a cuboidal workpiece so as to reduce the size of a crystal particle to that of a fine particle (for example, see PTL 1). As forging tools used for the multi-axis forging, a variety of tools have been proposed. For example, a forging tool has been proposed which includes a compression processing plate, an upper anvil, and a lower anvil. The compression processing plate has a rectangular compression chamber opening therein. The upper anvil is inserted into the compression chamber from above. The lower anvil has an upper surface that closes a lower surface of the compression chamber when the lower anvil is inserted into a path provided in a base (see PTL 2). In this forging tool, the workpiece can be removed from the path provided in the base by pulling the lower anvil. Also, a forging tool has been proposed which includes, as a member corresponding to the above-described compression processing plate, a member in which an inner die is fitted into an inner circumference of an outer die. A compression chamber is formed in the inner die by combining a plurality of die components with each other (for example, see PTL 3). Also, a forging tool has been proposed which includes an upper jig portion and a lower jig portion. The upper jig portion has a compression recess formed by a compression upper surface and two compression side surfaces continuously connected to the compression upper surface. The compression recess is disposed at one end edge portion of a bottom surface portion. The lower jig portion has a guide recess having a bottom surface portion (for example, see PTL 2). In this forging tool, a compression chamber is formed by the compression upper surface of the compression recess, the compression side surfaces of the compression recess, the bottom surface portion of the guide recess, and two side surface portions continuously connected to the bottom surface portion of the guide recess.

CITATION LIST

Patent Literature

PTL 1: WO 2009/119237 A1
PTL 2: JP 2006-116592 A
PTL 3: WO 2013/146309 A1

SUMMARY OF THE INVENTION

However, the forging tool in the form in which the upper anvil is inserted into the compression chamber, a load is applied with one surface of a lower end of the bar-shaped upper anvil in contact with the workpiece. Thus, misalignment may occur due to deformation of the workpiece when the load is applied, and a largest load may be applied in this state. Consequently, for example, the load may be concentrated in part of the workpiece, and the workpiece may be strongly stick to the upper anvil and the lower anvil. In this case, removal of the upper anvil and the lower anvil may become difficult resulting in an increase in difficulty in removing the workpiece. Meanwhile, with the forging tool that includes the upper jig portion having the compression recess, the workpiece is comparatively easily removed. However, the compression recess is provided at the one end edge portion of the bottom surface portion, and a load is applied with the compression upper surface of the compression recess in contact with the workpiece. Thus, misalignment may occur due to, for example, inclination of the upper jig portion toward the compression recess side caused by deformation of the workpiece when the load is applied, and a largest load may be applied in this state. Consequently, the load may be, for example, concentrated in a projecting angle portion of the compression upper surface of the compression recess not continuously connected to the compression side surfaces, and accordingly, the projecting corner portion may be damaged.

The present invention is made to solve such problems. A main object of the present invention is to provide a forging tool that permits easy removal of a workpiece and that itself is unlikely to be damaged.

In order to achieve the above-described main object, the following technique is employed for a forging tool according to the present invention.

That is, the forging tool according to the present invention is to forge a workpiece in a cuboidal forging space by using a first wall surface, a second wall surface adjacent to the first wall surface, a third wall surface that faces the first wall surface and is adjacent to the second wall surface, a fourth wall surface that faces the second wall surface and is adjacent to the first wall surface and the third wall surface, a fifth wall surface adjacent to the first to fourth wall surfaces, and a sixth wall surface that faces the fifth wall surface and is adjacent to the first to fourth wall surfaces. The forging tool at least includes a first die that forms the first wall surface and the second wall surface, and a second die that forms the third wall surface and the fourth wall surface.

The forging tool satisfies (a): the forging tool further includes, in addition to the first die and the second die, a third die that forms the sixth wall surface in a region surrounded by a contact surface when a bottom surface of the first die and a bottom surface of the second die are brought into contact with the contact surface; the first die forms a triangular region two sides of which are, of the fifth wall surface, a line of intersection of the first wall surface and the fifth wall surface and a line of intersection of the second wall surface and the fifth wall surface; the second die forms a triangular region two sides of which are, of the fifth wall surface, a line of intersection of the third wall surface and the fifth wall surface and a line of intersection of the fourth wall surface and the fifth wall surface; the workpiece is pressed between the fifth wall surface and the sixth wall surface; and the forging space is formed when the bottom surface of the first die and the bottom surface of the second die are brought into contact with the contact surface of the third die, or (b): the second die forms the fifth wall surface and the sixth wall surface; the first die has a first mating surface coplanar with the first wall surface and continuous with the first wall surface; the second die has a first facing surface that faces the first mating surface and that is brought into contact with the first mating surface; the second die further has a second mating surface coplanar with the third wall surface and continuous with the third wall surface; the first die has a second facing surface that faces the second mating surface and that is brought into contact with the second mating surface; the first facing surface, the second facing surface, the first mating surface, and the second mating surface are inclined relative to a plane perpendicular to a direction of a load so as to allow the second facing surface to move along the second mating surface and the first mating surface to move along the first facing surface when the load is applied to the first die and the second die in an axial direction of the forging tool; the workpiece is pressed between the second wall surface and the fourth wall surface; and the forging space is formed when a first die contact surface provided in the first die and a second die contact surface provided in the second die are brought into contact with each other.

In this forging tool, in the case where (a) is satisfied, the forging space opens at a central portion of the bottom surfaces when the first die and the second die are combined with each other, and the forging space is formed when the bottom surfaces of the first and second dies are brought into contact with the contact surface of the third die. Thus, even when misalignment occurs midway through the forging, the bottom surfaces of the first and second dies (that is, the entire circumference of the opening of the forging space S) are brought into contact with the contact surface of the third die at a last stage of the processing where the largest load is applied. This eliminates misalignment, and accordingly, concentration of the load in the workpiece is suppressed, the workpiece is unlikely to stick, and the forging tool itself is unlikely to be damaged. In the forging tool, in the case where (b) is satisfied, when the load is applied to the first die and the second die, the second facing surface moves along the second mating surface, the first mating surface moves along the first facing surface, and the first die contact surface and the second die contact surface are brought into contact with each other so as to form the forging space S. Thus, the likelihood of the occurrences of misalignment is reduced when the workpiece is pressed. This can suppress damage to the forging tool and an increase in difficulty in removing the workpiece due to misalignment. Furthermore, in both the cases where (a) is satisfied and where (b) is satisfied, out of the four sides around the workpiece, the first and second wall surfaces adjacent to each other are provided in the first die and the third and fourth wall surfaces adjacent to each other are provided in the second die. Thus, the workpiece applies to the first and second dies forces in directions in which the first and second dies are separated from each other. Thus, the workpiece can be easily removed from the first to fourth wall surfaces. The cuboidal shape herein includes a cuboidal shape in which the angles formed between the adjacent wall surfaces of the first to sixth walls is 90±10° in addition to a cuboidal shape in a strict sense in which all the angles formed between the adjacent wall surfaces of the first to sixth walls are 90°. Also, in addition to a cuboidal shape in which the adjacent wall surfaces of the first to sixth wall surfaces are in contact with each other without a gap, the cuboidal shape includes a cuboidal shape in which such a gap that does not influence forging (for example, not greater than 3 mm) is formed (however, except for a cuboidal shape having gaps between the first wall surface and the second wall surface and the third wall surface and the fourth wall surface).

In the forging tool according to the present invention, an angle formed between the first wall surface and the second wall surface and an angle formed between the third wall surface and the fourth wall surface may be greater than 90°. In this way, the workpiece is unlikely to be got stuck in between the angle formed between the first wall surface and the second wall surface or the angle formed between the third wall surface and the fourth wall surface. Thus, the workpiece can be more easily removed. Preferably, these angles are greater than 90° but not greater than 95°, more preferably greater than or equal to 90.5° but not greater than 94°, and further more preferably greater than or equal to 91° but not greater than 93°. When these angles are greater than or equal to 90°, the workpiece is more easily removed. When these angles are not greater than 95°, the workpiece is processed into a shape close to a cuboid in a strict sense. This allows stable placement of the workpiece for the next forging after the previous forging.

The forging tool according to the present invention may be a forging tool as follows: The forging tool satisfies (a) described above; in this forging tool, the first die and the second die are members formed so as to become, when the first die and the second die are combined with each other, a columnar body in which the forging space opens into a bottom surface formed by the bottom surface of the first die and the bottom surface of the second die; an outer circumferential surface of the columnar body is inclined so as to approach an axis of the forging tool from the bottom surface of the columnar body toward an upper surface opposite the bottom surface; this forging tool further includes a cylindrical member that is disposed at the outer circumferential surface of the columnar body which has a bottom surface formed to be flush with the bottom surface of the columnar body. The columnar body has a diameter that reduces from the bottom surface toward the upper surface, and the cylindrical member the bottom surface of which is disposed flush with the bottom surface of the columnar body is disposed at the outer circumferential surface of the columnar body. Thus, separation of the first die and second die can be suppressed by the cylindrical member when the workpiece is pressed. In addition, the columnar body is easily pulled from the cylindrical member when the workpiece is removed. Accordingly, the first die and the second die are easily separated from each other, and the workpiece is easily removed. In this forging tool, preferably, the outer circumferential surface of the columnar body is inclined relative to the axis of the forging tool by an angle not greater than 45°, and more preferably by an angle greater than or equal to 3° but not greater than 10°. When this angle is greater than or equal to 3°, the cylindrical member is easily removed from the columnar body. When this angle is not greater than 10°, the area of the upper surface of the columnar body can be comparatively increased. This allows suppression of a load applied to the upper surface of the columnar body so as to suppress damage to the forging tool itself. Herein, in addition to a columnar shape having a uniform diameter such as a cylinder or a prism, the shape of the columnar body includes a frustum shape such as a frustocone or a frustum of pyramid having a varied diameter.

In the forging tool that satisfies (a) and includes the cylindrical member, the third die may have a bottomed cylindrical recess that has a bottom surface including the contact surface and that has an inner circumferential surface rising from the bottom surface. In this case, an outer diameter of the bottom surface of the recess is coincident with an outer diameter of the bottom surface of the cylindrical member. In this way, when the workpiece is pressed, the forces in the directions in which the first die and the second die are separated from each other can be received not only by the cylindrical member but also by the third die. This can further suppress damage to the forging tool itself.

In the forging tool that satisfies (a) and includes the cylindrical member, an inner circumferential surface of the third die may be inclined so as to be separated from the axis of the forging tool from the bottom surface toward an opening surface opposite the bottom surface. In this way, the cylindrical member and the first and second dies are more easily removed from the third die. As a result, the workpiece can be more easily removed. In this forging tool, preferably, the inner circumferential surface of the third die is inclined relative to the axis of the forging tool by an angle not greater than 10°, and more preferably by an angle greater than or equal to 0.5° but not greater than 10°. When this angle is greater than or equal to 0.5°, the cylindrical member and the first and second dies are more easily removed from the third die. Also, setting this angle to an angle not greater than 10° allows reception of more of the forces in the directions in which the first die and the second die are separated from each other when the workpiece is pressed. This can further suppress damage to the forging tool itself. This forging tool may have a guide surface that is provided at an outer circumference of the bottom surface of the cylindrical member. In this case, the guide surface faces the inner circumferential surface of the third die and is brought into contact with the inner circumferential surface of the third die when the guide surface is brought into contact with the contact surface of the third die. In this way, the cylindrical member is inserted into the recess of the third die while being guided by the inner circumferential surface of the third die. This can further suppress misalignment.

The forging tool according to the present invention may be a forging tool as follows: the forging tool satisfied (a) described above; the first die and the second die are members formed so as to become, when the first die and the second die are combined with each other, a columnar body in which the forging space opens into a bottom surface formed by the bottom surface of the first die and the bottom surface of the second die; and the third die has a bottomed cylindrical recess that has a bottom surface including the contact surface and that has an inner circumferential surface rising from the bottom surface, and an outer diameter of the bottom surface of the recess is coincident with an outer diameter of the bottom surface of the columnar body. That is, the above-described cylindrical member may be omitted. In this way, when the workpiece is pressed, separation of the first die and the second die from each other can be suppressed by the recess of the third die. In addition, since the cylindrical member is not provided, when the workpiece is removed, the first die and the second die are more easily separated from each other, and the workpiece is easily removed.

In the forging tool which satisfies (a) and from which the cylindrical member is omitted, the inner circumferential surface of the third die may be inclined so as to be separated from the axis of the forging tool from the bottom surface toward an opening surface opposite the bottom surface. In this way, the first and second dies are more easily removed from the third die. As a result, the workpiece can be more easily removed. In this forging tool, the inner circumferential surface of the third die is preferably inclined relative to the axis of the forging tool by an angle not greater than 10°, and more preferably inclined relative to the axis of the forging tool by an angle greater than or equal to 0.5° but not greater than 10°. When this angle is greater than or equal to 0.5°, the first and second dies are more easily removed from the third die. Setting this angle to an angle not greater than 10° can further suppress separation of the first die and the second die from each other when the workpiece is pressed.

The forging tool which satisfies (a) and from which the cylindrical member is omitted may have a guide surface disposed at an outer circumference of the bottom surface of the columnar body. In this case, the guide surface faces the inner circumferential surface of the third die and is brought into contact with the inner circumferential surface of the third die when the guide surface is brought into contact with the contact surface of the third die. In this way, the columnar body is inserted into the recess of the third die while being guided by the inner circumferential surface of the third die. This can further suppress misalignment.

The forging tool according to the present invention may be a forging tool as follows: the forging tool satisfies (b) described above; the second die contact surface is formed on a side of the first facing surface opposite the fourth wall surface so as to rise from the first facing surface; and the first die contact surface is formed on a side of the first mating surface opposite the first wall surface so as to be brought into contact with the second die contact surface. In this way, it is sufficient that the second facing surface, the second wall surface, a surface including the first wall surface and the first mating surface, and the first die contact surface be formed into a stepped shape in the first die, and it is sufficient that a surface including the second mating surface and the third wall surface, the fourth wall surface, the first facing surface, and the second die contact surface be formed into a stepped shape in the second die. Thus, the shape of the forging tool itself is not complex, and the forging tool itself is unlikely to be damaged.

In the forging tool that satisfies the (b), the second die may have a recess that has a first side surface which rises from one end of a bottom surface formed by the second mating surface and the third wall surface and which forms the fifth wall surface, and a second side surface which rises from another end of the bottom surface and which forms the sixth wall surface. In this case, the first side surface and the second side surface are inclined such that a distance between the first side surface and the second side surface increases from the bottom surface toward an opening of the recess. Thus, since the opening side of the recess is larger as described above, the workpiece is more easily removed. In this forging tool, preferably, the first side surface is inclined relative to a plane that rises from the one end of the bottom surface and that is parallel to the axis of the forging tool by an angle not greater than 10°, and more preferably by an angle greater than or equal to 1° but not greater than 10°. Also, preferably, the second side surface is inclined relative to a plane that rises from the other end of the bottom surface and that is parallel to the axis of the forging tool by an angle not greater than 10°, and more preferably by an angle greater than or equal to 1° but not greater than 10°. When this angle is greater than or equal to 1°, the workpiece is more easily removed. When the angle is not greater than 10°, the workpiece can be processed into a shape close to a cuboid in a strict sense.

In the forging tool that satisfies the (b), the first mating surface, the second mating surface, the first facing surface, and the second facing surface may be inclined relative to a plane perpendicular to the direction of the load by an angle greater than or equal to 45° but not greater than 75°. When this angle is greater than or equal to 45°, a load applied to the forging tool is more sufficiently transferred to the workpiece, and when this angle is not greater than 75°, the likelihood of the first die and the second die becoming out of alignment is further reduced.

DETAILED DESCRIPTION OF THE INVENTION

Next, embodiments of the present invention are described with reference to the drawings.

First Embodiment

Figure 1:
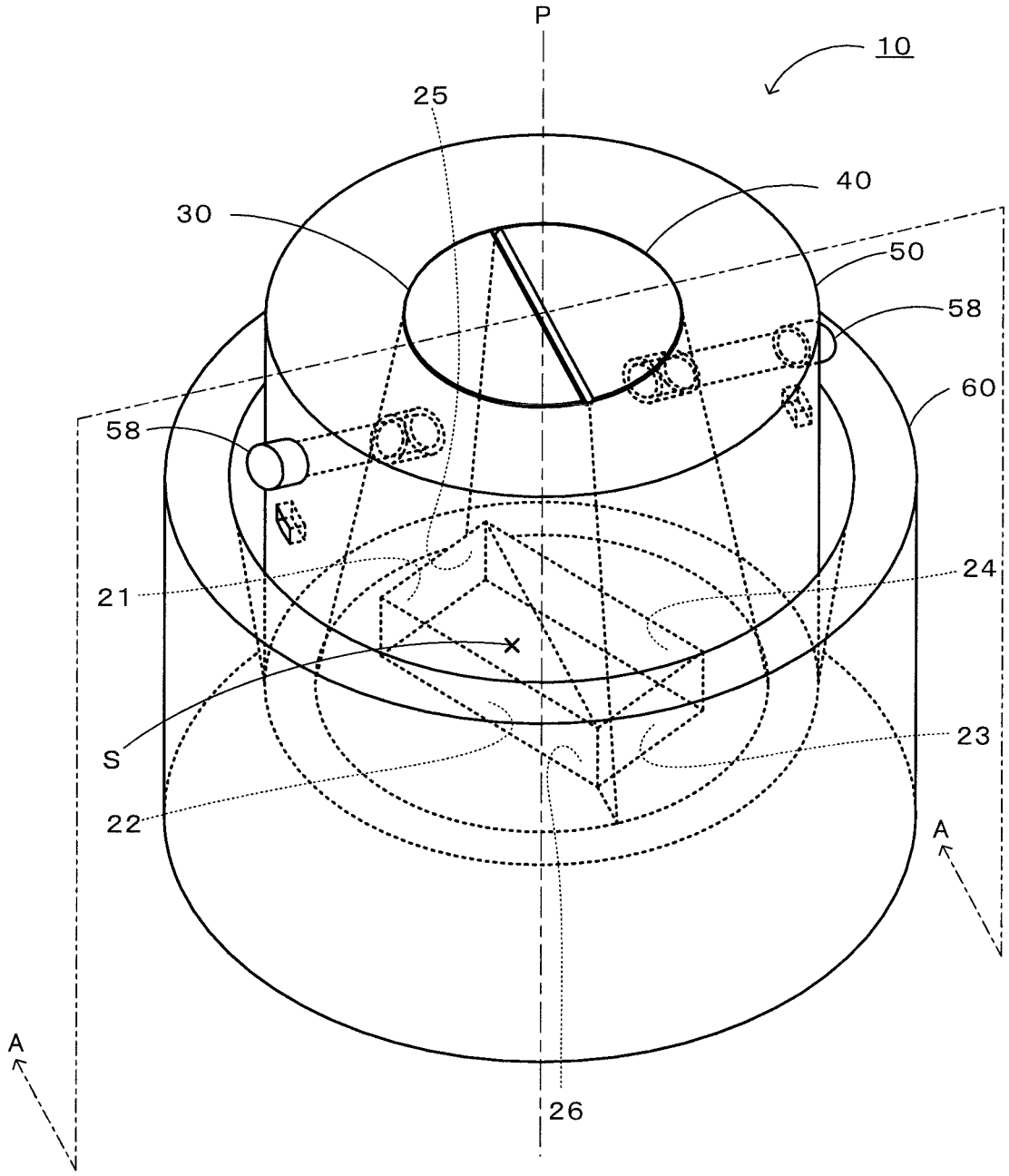
FIG. 1 is a perspective view of a forging tool 10.
Figure 2:
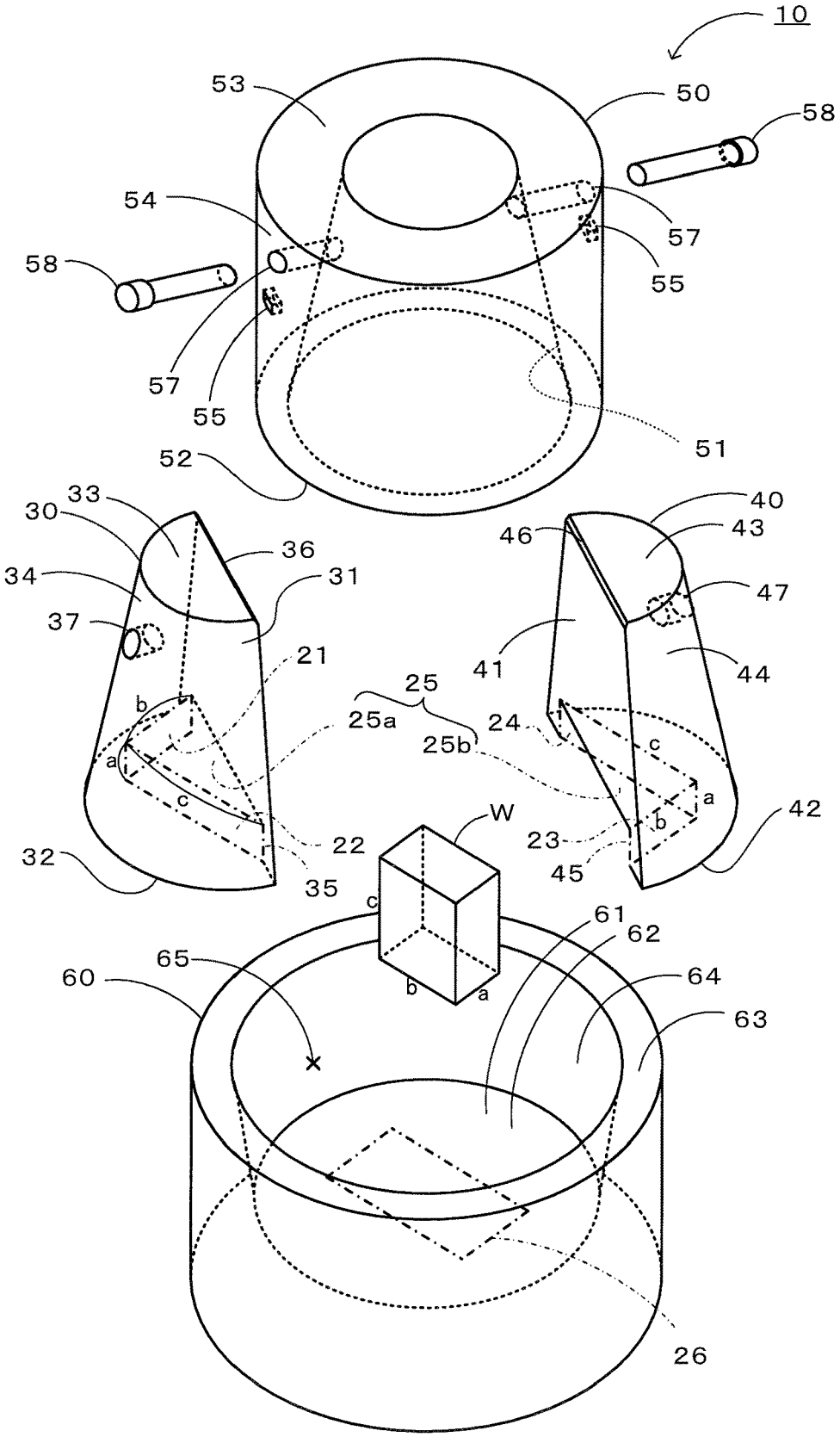
FIG. 2 is an exploded perspective view of the forging tool 10.
Figure 3:
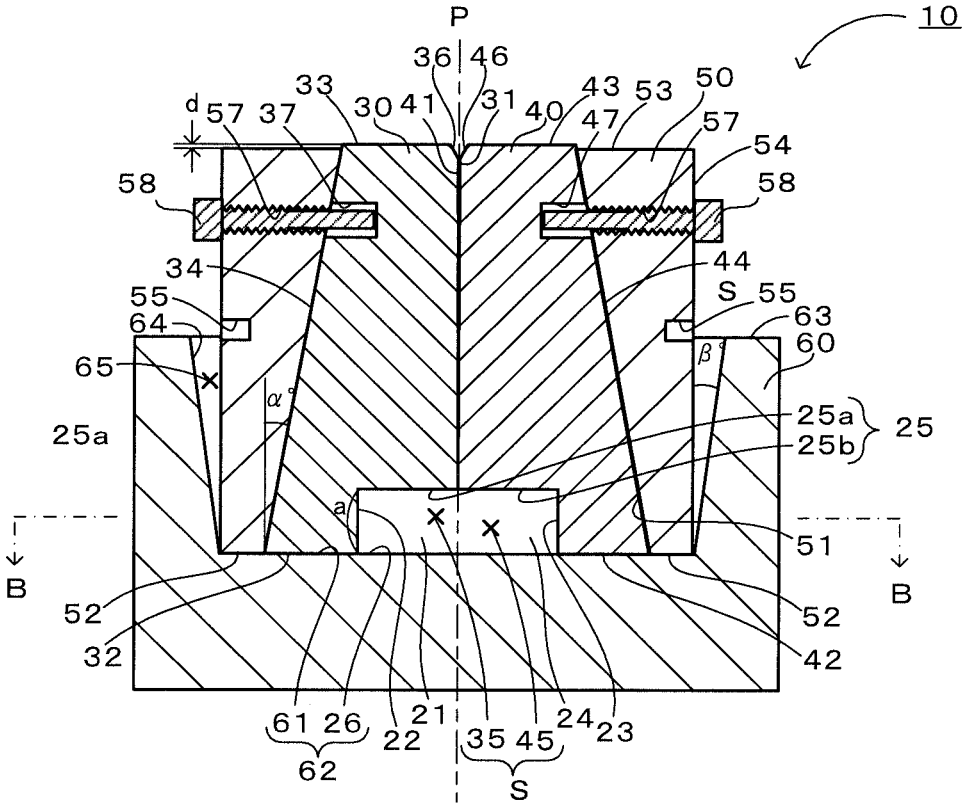
FIG. 3 is a sectional view of the forging tool 10 taken along line A-A illustrated in FIG. 1.
Figure 4:
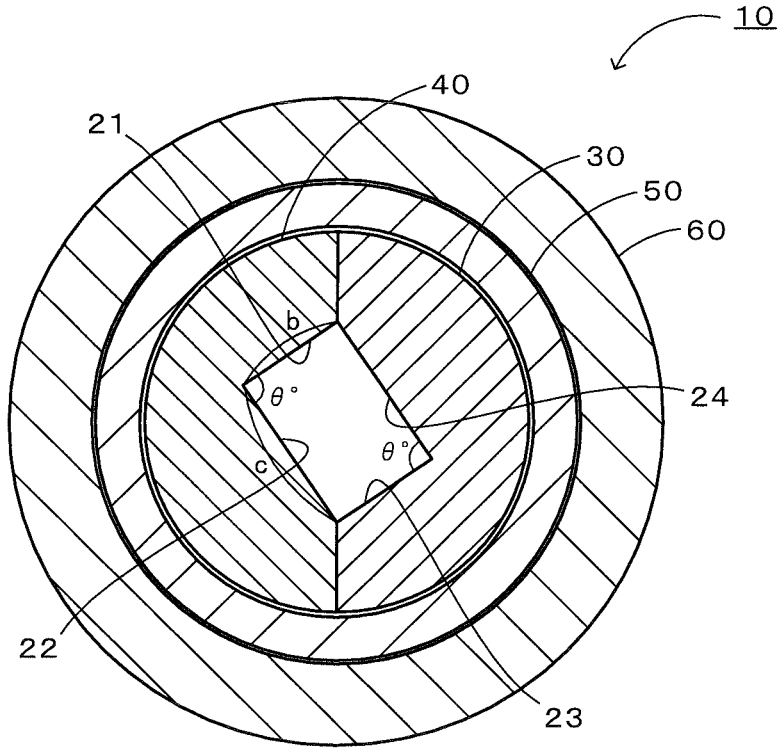
FIG. 4 is a sectional view of the forging tool 10 taken along B-B section illustrated in FIG. 3.
Figure 5:
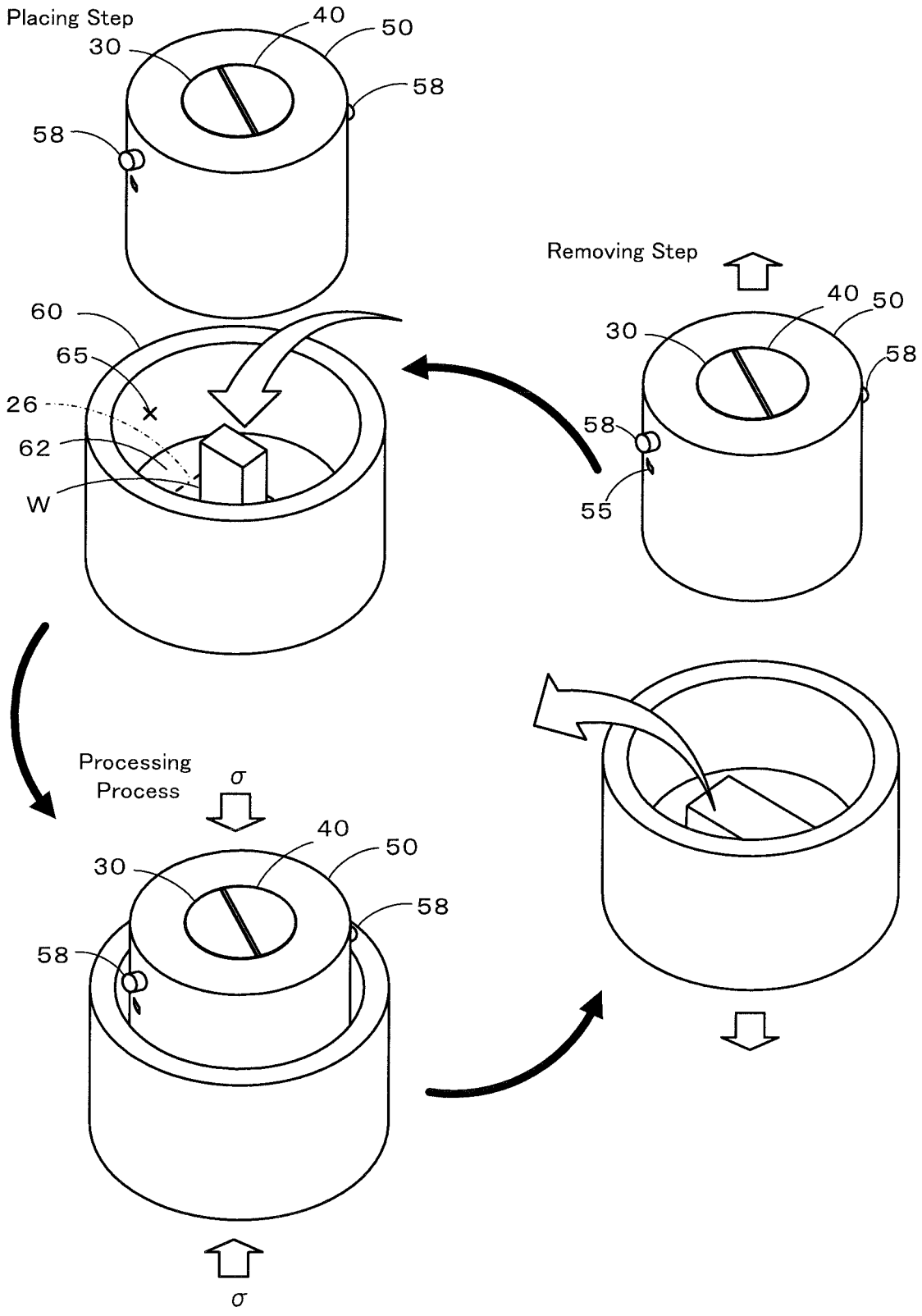
FIG. 5 is an explanatory view illustrating a method of forging with the forging tool 10.
Figure 6:
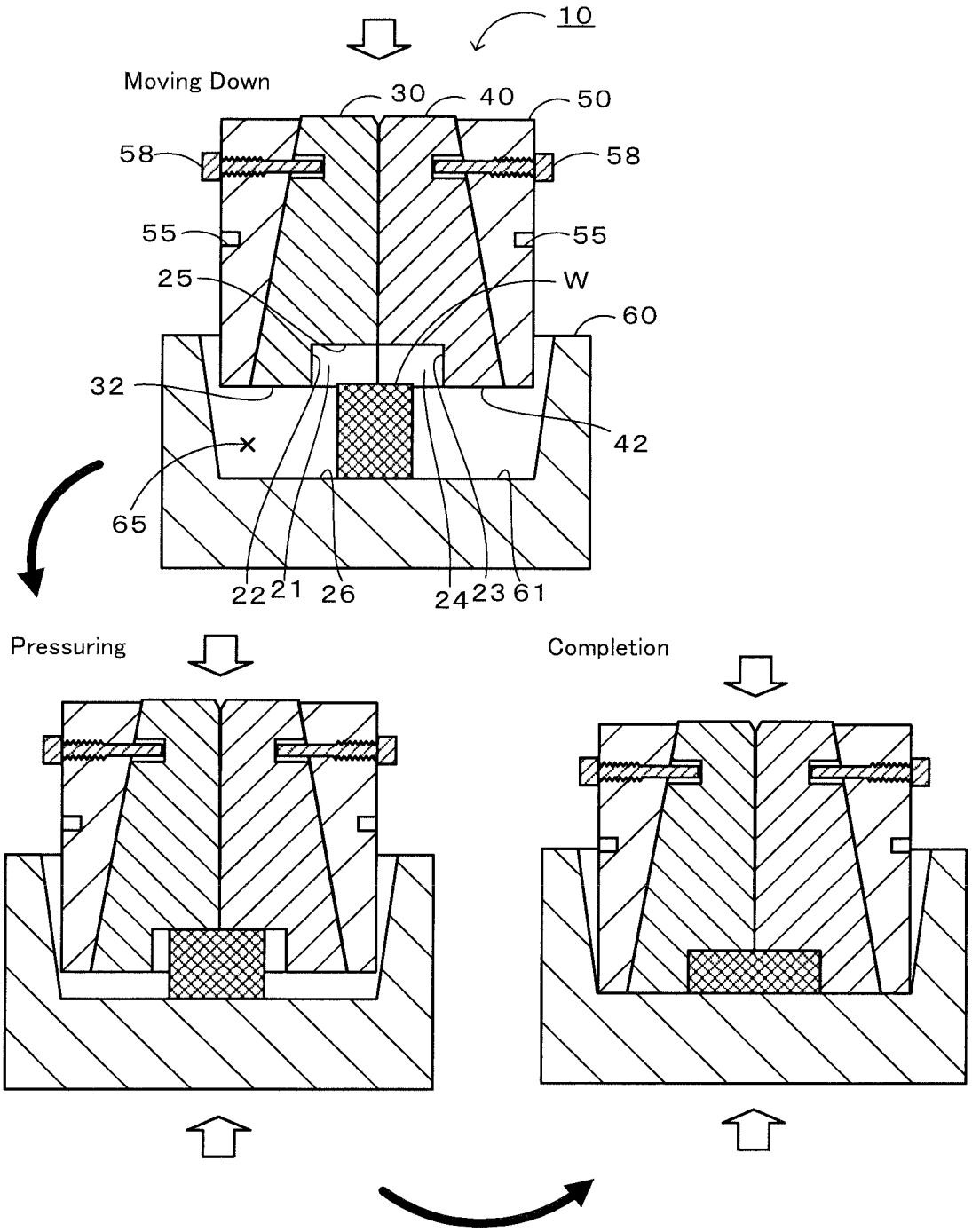
FIG. 6 is an explanatory view of a processing step in the method of forging with the forging tool 10.
Figure 7:
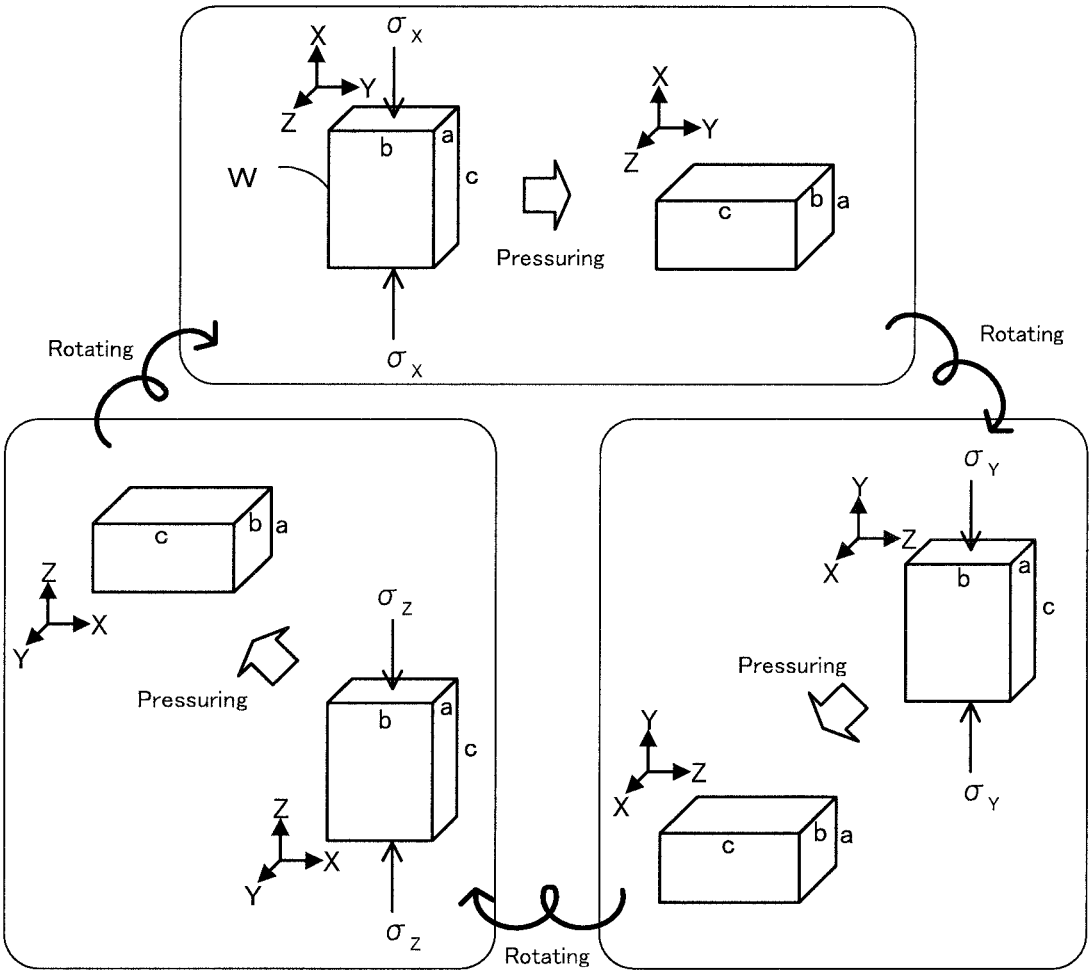
FIG. 7 is an explanatory view illustrating deformation of a workpiece W in the method of forging with the forging tool 10.

FIG. 1 is a perspective view of a forging tool 10 according to a first embodiment. FIG. 2 is an exploded perspective view of the forging tool 10. FIG. 3 is a sectional view of the forging tool 10 taken along line A-A illustrated in FIG. 1. FIG. 4 is a sectional view of the forging tool 10 taken along B-B section illustrated in FIG. 3. FIG. 5 is an explanatory view illustrating a method of forging with the forging tool 10. FIG. 6 is an explanatory view of a processing step in the method of forging with the forging tool 10. FIG. 7 is an explanatory view illustrating deformation of a workpiece W in the method of forging with the forging tool 10. Although hidden lines are indicated by broken lines in FIGS. 1 and 2, a subset of broken lines are omitted.

The forging tool 10 is used for so-called multi-axis forging in which plastic strain is sequentially added in the X, Y, Z axis directions of the workpiece W perpendicular to each other by forging to the workpiece W having a cuboidal shape. As illustrated in FIGS. 1 to 4, the forging tool 10 has a first wall surface 21, a second wall surface 22 adjacent to the first wall surface 21, a third wall surface 23 that faces the first wall surface 21 and is adjacent to the second wall surface 22, a fourth wall surface 24 that faces the second wall surface 22 and is adjacent to the first wall surface 21 and the third wall surface 23, a fifth wall surface 25 adjacent to the first to fourth wall surfaces 21 to 24, and a sixth wall surface 26 that faces the fifth wall surface 25 and is adjacent to the first to fourth wall surfaces 21 to 24. These first to sixth wall surfaces 21 to 26 form a cuboid-shaped forging space S. The workpiece W is forged in this forging space S of the forging tool 10. In FIG. 2, the outlines of the first to sixth wall surfaces 21 to 26 are indicated by dotted chain lines.

The forging tool 10 includes a first die 30, a second die 40, a cylindrical member 50, and a third die 60. These components may be formed of, for example, alloy tool steel examples of which include hot work tool steel such as hot work die steel (for example, SKD61) and cold work tool steel such as cold work die steel or a nickel based alloy such as Hastelloy (Hastelloy is a registered trademark). A load is applied in the direction of an axis P to the forging tool 10. The axis P of the forging tool 10 is coincident with the axis of a frustocone (columnar body) formed by combining the first die 30 and the second die 40 with each other, the axis of the cylindrical member 50, and the axis of a recess of the third die 60.

The first die 30 and the second die 40 are members formed so as to become, when the first die 30 and the second die 40 are combined with each other at mating surfaces 31, 41, the frustocone in which the forging space S opens into bottom surfaces 32, 42 is formed. Outer circumferential surfaces 34, 44 of the frustocone are inclined relative to the axis P by $\alpha°$ so as to approach the axis P of the forging tool 10 from the bottom surfaces 32, 42 toward upper surfaces 33, 43 (see FIG. 3). Preferably, $\alpha°$ is greater than 0° but not greater than 45°, and more preferably greater than or equal to 3° but not greater than 10°. When $\alpha°$ is greater than or equal to 3°, the cylindrical member 50 is easily removed from the frustocone. When $\alpha°$ is not greater than 10°, the areas of the upper surfaces 33, 43 of the frustocone can be comparatively increased. This allows suppression of a load applied to the upper surfaces 33, 43 of the frustocone so as to suppress damage to the forging tool 10 itself.

The first die 30 has a semi-frustoconical shape formed by cutting the frustocone into halves along a plane including the axis P. The first die 30 forms the first wall surface 21 and the second wall surface 22. In addition, the first die 30 forms a ceiling portion 25*a* that is a triangular region. Two of the sides of the triangular region are, of the fifth wall surface 25, a line of intersection of the first wall surface 21 and the fifth wall surface 25 and a line of intersection of the second wall surface 22 and the fifth wall surface 25. A recess 35 that is part of the forging space S is formed at the center in a corner where the mating surface 31 and the bottom surface 32 intersect each other. The recess 35 is defined by the ceiling portion 25*a*, the first wall surface 21, and the second wall surface 22. The ceiling portion 25*a* having a triangular shape is parallel to the bottom surface 32. The long side of the ceiling portion 25*a* is positioned on the mating surface 31. The first wall surface 21 rises from one of the sides of the ceiling portion 25*a* other than the long side so as to be parallel to the axis P. The second wall surface 22 rises from another of the sides of the ceiling portion 25*a* other than the long side so as to be parallel to the axis P. The recess 35 is formed such that the depth from the bottom surface 32 is a, the width of the first wall surface 21 is b, and the width of the second wall surface 22 is c (here, $a<b<c$) (see FIG. 3). Although the value of a, b, or c is not particularly limited, for example, a, b, and c preferably satisfy $1.03a \leq b \leq 1.49a$ and 1.06a≤c≤2.22a. In these ranges, when 1.10a≤b≤1.20a and 1.21a≤c≤1.44a are satisfied, strain in forging passes is comparatively small, and the multi-axis forging can be more easily performed. When an axial ratio (value of c/a) is large, the multi-axis forging can be performed through a reduced number of forming passes. However, in the case where, for example, a workpiece formed of a brittle material is processed, the workpiece may crack. The values of a, b, and c preferably satisfy $c=b^2/a$. Furthermore, the recess 35 is formed such that an angle formed between the first wall surface 21 and the second wall surface 22 is θ° that is greater than or equal to 90° (see FIG. 4). The value of θ° is preferably greater than 90° but not greater than 95°, more preferably greater than or equal to 90.5° but not greater than 94°, and further more preferably greater than or equal to 91° but not greater than 93°. When θ° is greater than or equal to 90°, the workpiece W is more easily removed. When θ° is not greater than 95°, the workpiece W is processed into a shape close to a cuboid in a strict sense. This allows stable placement of the workpiece W for the next forging after the previous forging. A chamfer-shaped surface 36 is formed at a corner where the mating surface 31 and the upper surface 33 intersect each other. A bottomed hole 37 having a circular opening opens toward the mating surface 31 in an upper central region of the outer circumferential surface 34.

The second die 40 has a semi-frustoconical shape formed by cutting the frustocone into halves along a plane including the axis P. The second die 40 forms the third wall surface 23 and the fourth wall surface 24. In addition, the second die 40 forms a ceiling portion 25*b* that is a triangular region. Two of the sides of the triangular region are, of the fifth wall surface 25, a line of intersection of the third wall surface 23 and the fifth wall surface 25 and a line of intersection of the fourth wall surface 24 and the fifth wall surface 25. A recess 45 that is part of the forging space S is formed at the center in a corner where the mating surface 41 and the bottom surface 42 intersect each other. The recess 45 is defined by the ceiling portion 25*b*, the third wall surface 23, and the fourth wall surface 24. The ceiling portion 25*b* having a triangular shape is parallel to the bottom surface 42. The long side of the ceiling portion 25*b* is positioned on the mating surface 41. The third wall surface 23 rises from one of the sides of the ceiling portion 25*b* other than the long side so as to be parallel to the axis P. The second wall surface 24 rises from another of the sides of the ceiling portion 25*b* other than the long side so as to be parallel to the axis P. The ceiling portion 25*b* together with the ceiling portion 25*a* of the first die 30 form the fifth wall surface 25 of the forging space S. The recess 45 is formed such that the depth from the bottom surface 42 is a, the width of the third wall surface 23 is b, and the width of the fourth wall surface 24 is c (here, a<b<c) (see FIG. 3). The values of a, b, and c are the same as those of the first die 30. Furthermore, the recess 45 is formed such that an angle formed between the third wall surface 23 and the fourth wall surface 24 is θ° that is greater than or equal to 90° (see FIG. 4). The value of θ° is the same as that of the first die 30. A chamfer-shaped surface 46 is formed at a corner where the mating surface 41 and the upper surface 43 intersect each other. This surface 46 together with the surface 36 of the first die 30 form a V-shaped groove the bottom of the V shape of which is connected to the mating surfaces 31, 41 of the first and second dies 30, 40. The first die 30 and the second die 40 can be easily separated by inserting a bar-shaped jig or the like toward the bottom of the V-shaped groove. This V-shaped groove may be omitted. A bottomed hole 47 having a circular opening opens toward the mating surface 41 in an upper central portion of the outer circumferential surface 44.

The cylindrical member 50 is disposed at an outer circumference of the frustocone that is a combination of the first die 30 and the second die 40. The cylindrical member 50 has a cylindrical shape that opens at both ends. The cylindrical member 50 is formed such that an inner circumferential surface 51 is brought into contact with the outer circumferential surfaces 34, 44 of the first die 30 and the second die 40 and a bottom surface 52 is disposed flush with the bottom surfaces 32, 42 of the first die 30 and the second die 40. Furthermore, an upper surface 53 is disposed flush with or below the upper surfaces 33, 43 of the first die 30 and second die 40 (see FIG. 3). Basically, a difference d in height between the upper surfaces 33, 43 and the upper surface 53 can be 0 mm. However, the difference d may be set to greater than 0 mm in consideration of deformation of the first and second dies when a load is applied to the first and second dies. The value of d is preferably about a value with which the mating surfaces 31, 41 of the first and second dies 30, 40 are not separated from each other even when the load is applied, for example, a value not greater than 1 mm or the like. The value of d may be slightly negative, that is, such a value with which the upper surface 53 is slightly higher than the upper surfaces 33, 43. An outer circumferential surface 54 has a cylindrical shape and has two bottomed lever holes 55 opening therein at respective positions that face each other. The lever holes 55 are used when removing the cylindrical member 50 from the third die 60. The lever holes 55 are formed so as to allow insertion of bar-shaped jigs thereinto. The inserted bar-shaped jigs can pull the cylindrical member 50 upward about an opening surface 63 of the third die 60 as a fulcrum. The lever holes 55 may be omitted. The cylindrical member 50 has through holes 57 opening in an upper portion thereof. The through holes 57 penetrate from the outer circumferential surface 54 to the inner circumferential surface 51 and are connected to the bottomed holes 37, 47 of the first die 30 and the second die 40. The diameter of the through holes 57 is smaller than that of the bottomed holes 37, 47 of the first and second dies 30, 40, and female threads are formed in inner circumferences of the through holes 57. The first die 30, the second die 40, and the cylindrical member 50 are secured by inserting bolts 58 from the outer circumferential surface 54 side of the through holes 57 and screwing the bolts 58 to positions where distal ends of the bolts 58 reach the bottomed holes 37, 47 of the first die 30 and the second die 40 so as to hook the first die 30 and the second dies 40 on the bolts 58.

The third die 60 has a contact surface 61 that is brought into contact with the bottom surfaces 32, 42 of the first die 30 and the second die 40 in a state in which the mating surfaces 31, 41 are mated with each other. When the bottom surfaces 32, 42 and the contact surface 61 are brought into contact with each other, a region surrounded by the contact surface 61 forms the sixth wall surface 26. The third die 60 has a recess 65 that has a bottomed cylindrical shape. The recess 65 has a bottom surface 62 and an inner circumferential surface 64. The bottom surface 62 includes the contact surface 61. The inner circumferential surface 64 rises from the bottom surface 62. The outer diameter of the bottom surface 62 of the recess 65 of the third die is coincident with the outer diameter of the bottom surface 52 of the cylindrical member 50. The inner circumferential surface 64 is inclined relative to the axis P by an angle of β° so as to be separated from the axis P from the bottom surface 62 toward the opening surface 63 (see FIG. 3). The inner circumferential surface 64 is preferably inclined relative to the axis P by an angle not greater than 10°, and more preferably inclined by an angle greater than or equal to 0.5° but not greater than 10°. When this angle is greater than or equal to 0.5°, the cylindrical member 50 and the first and second dies 30, 40 are more easily removed from the third die 60. Also, setting this angle to an angle not greater than 10° allows reception of more of forces in the directions in which the first die 30 and the second die 40 are separated from each other when the workpiece W is pressed. This can further suppress damage to the forging tool 10 itself. The third die 60 may include a removable plate member at the bottom of the recess 65, and a surface of this plate member may serve as the bottom surface 62. In this way, wear or like of the main body of the third die 60 can be further suppressed.

Next, a method of performing multi-axis forging on the workpiece W with the forging tool 10 is described. As the workpiece W, a cuboid-shaped workpiece the lengths of the sides of which correspond to the values of a, b, and c (here, a<b<c) of the first and second dies 30, 40 described above is used. For example, titanium, a titanium alloy, copper, a copper alloy, a steel material such as stainless steel, an aluminum alloy, a magnesium alloy, or the like can be used as the workpiece W.

For example, as illustrated in FIGS. 5 and 6, this method of performing multi-axis forging includes a placing step, the processing step, and a removing step. The workpiece W having a first shape is placed in the third die 60 in the placing step. The placed workpiece W is deformed into a second shape corresponding to the shape of the forging space S (see FIG. 1) so as to add plastic strain to the workpiece W in the processing process. The processed workpiece W is removed in the removing step. Steps from the placing step to the removing step may be repeated twice or more. The lengths of the sides are a, b, and c in both the first shape and the second shape. However, the first shape and the second shape are different from each other in that the side of the first shape having a length of c becomes the side of the second shape having a length of a, the side of the first shape having a length of b becomes the side of the second shape having a length of c, and the side of the first shape having a length of a becomes the side of the second shape having a length of b.

The workpiece W is placed in a region of the bottom surface 62 of the third die 60 forming the sixth wall surface 26 in the placing step. At this time, the workpiece W is placed such that the surfaces of the workpiece W surrounded by the sides having lengths of a and c face the first and third wall surfaces 21, 23 surrounded by the sides having lengths of a and b, the surfaces of the workpiece W surrounded by the sides having lengths of b and c face the second and fourth wall surfaces 22, 24 surrounded by the sides having lengths of a and c, and the surfaces of the workpiece W surrounded by the sides having lengths of a and b face the fifth and sixth wall surfaces 25, 26 surrounded by the sides having lengths of b and c.

As illustrated in FIGS. 5 and 6, in the processing step, the first die 30, the second die 40, and the cylindrical member 50 that are secured by the bolts 58 are moved down so as to be inserted into the recess 65 of the third die 60 and subjected to pressure from above until the bottom surfaces 32, 42 of the first and second dies 30, 40 are brought into contact with the contact surface 61 of the third die 60. This causes the workpiece W to be pressed between the fifth wall surface 25 and the sixth wall surface 26. When the bottom surfaces 32, 42 of the first and second dies 30, 40 are brought into contact with the contact surface 61 of the third die 60, the forging space S is formed, and the workpiece W is deformed into the second shape corresponding to the shape of the forging space S. The workpiece W assumes a state in which the surfaces of the workpiece W surrounded by the sides having the lengths of a and b face the first and third wall surfaces 21, 23, the surfaces of the workpiece W surrounded by the sides having the lengths of a and c face the second and fourth wall surfaces 22, 24, and the surfaces of the workpiece W surrounded by the sides having the lengths of b and c face the fifth and sixth wall surfaces 25, 26.

In the removing step, first, the bar-shaped jigs (not illustrated) are inserted into the lever holes 55 of the cylindrical member 50 so as to pull the cylindrical member 50 upward about the opening surface 63 of the third die 60 as the fulcrum. Thus, the first die 30 and the second die 40 secured to the cylindrical member 50 by the bolts 58 can be pulled up from an inner circumference of the recess 65 of the third die 60. Next, according to need, the bolts 58 are loosened or removed so as to separate the first die 30, the second die 40, and the cylindrical member 50 from each other, and the workpiece W is removed.

Next, the removed workpiece W is rotated, and the steps from the placing step to the removing step are performed again. These operations are repeated as many times as necessary. Thus, as illustrated in FIG. 7, plastic strain can be sequentially added in the X, Y, Z axis directions of the workpiece W perpendicular to each other by forging. That is, when a load $\sigma x$ is applied in the X axis direction of the workpiece W in the initial processing step, then, a load $\sigma y$ is applied in the Y axis direction, and then, a load $\sigma z$ is applied in the Z axis direction. Thus, plastic strain can be sequentially added in the X, Y, and Z axis directions of the workpiece W perpendicular to each other.

In the forging tool 10 described above, the forging space S opens at a central portion of a bottom surface formed by the bottom surface of 32, 42 of the combination of the first die 30 and the second die 40, and the forging space S is formed when the first and second dies 30, 40 are brought into contact with the contact surface 61 of the third die 60. Thus, even when misalignment occurs midway through the forging, the bottom surfaces 32, 42 of the first and second dies 30, 40 (that is, the entire circumference of the opening of the forging space S) are brought into contact with the contact surface 61 of the third die 60 at a last stage of the processing where the largest load is applied (see the drawing of completion illustrated in FIG. 6). This eliminates misalignment, and accordingly, the workpiece W is unlikely to stick and the forging tool itself is unlikely to be damaged. Furthermore, out of the four sides around the workpiece W, the first and second wall surfaces 21, 22 adjacent to each other are provided in the first die 30 and the third and fourth wall surfaces 23, 24 adjacent to each other are provided in the second die 40. Thus, the workpiece W applies to the first and second dies 30, 40 forces in directions in which the first and second dies 30, 40 are separated from each other. Thus, the workpiece W can be easily removed from the first to fourth wall surfaces 21 to 24.

Also in the forging tool 10, the frustocone formed by mating at the mating surfaces 31, 41 has a diameter that reduces from the bottom surfaces 32, 42 toward the upper surfaces 33, 43, and the cylindrical member 50 the bottom surface 52 of which is disposed flush with the bottom surfaces 32, 42 of the frustocone is disposed at the outer circumferential surfaces 34, 44 of the frustocone. Thus, separation of the first die 30 and second die 40 can be suppressed by the cylindrical member 50 when the workpiece W is pressed. In addition, the frustocone is easily pulled from the cylindrical member 50 when the workpiece W is removed. Accordingly, the first die 30 and the second die 40 are easily separated from each other, and the workpiece W is easily removed.

Furthermore, in the forging tool 10, the third die 60 has the recess 65 that has a bottomed cylindrical shape. The recess 65 has the bottom surface 62 and the inner circumferential surface 64. The bottom surface 62 includes the contact surface 61. The inner circumferential surface 64 rises from the bottom surface 62. The outer diameter of the bottom surface 62 of the recess 65 is coincident with the outer diameter of the bottom surface 52 of the cylindrical member 50. Thus, when the workpiece W is pressed, the forces in the directions in which the first die 30 and the second die 40 are separated from each other can be received not only by the cylindrical member 50 but also by the third die 60. This can further suppress damage to the forging tool 10 itself.

Also in the forging tool 10, the inner circumferential surface 64 of the third die 60 is inclined so as to be separated from the axis P from the bottom surface 62 toward the opening surface 63. This facilitates removal of the cylindrical member 50 and the first and second dies 30, 40 from the third die 60. As a result, the workpiece W can be more easily removed.

Second Embodiment

Figure 8:
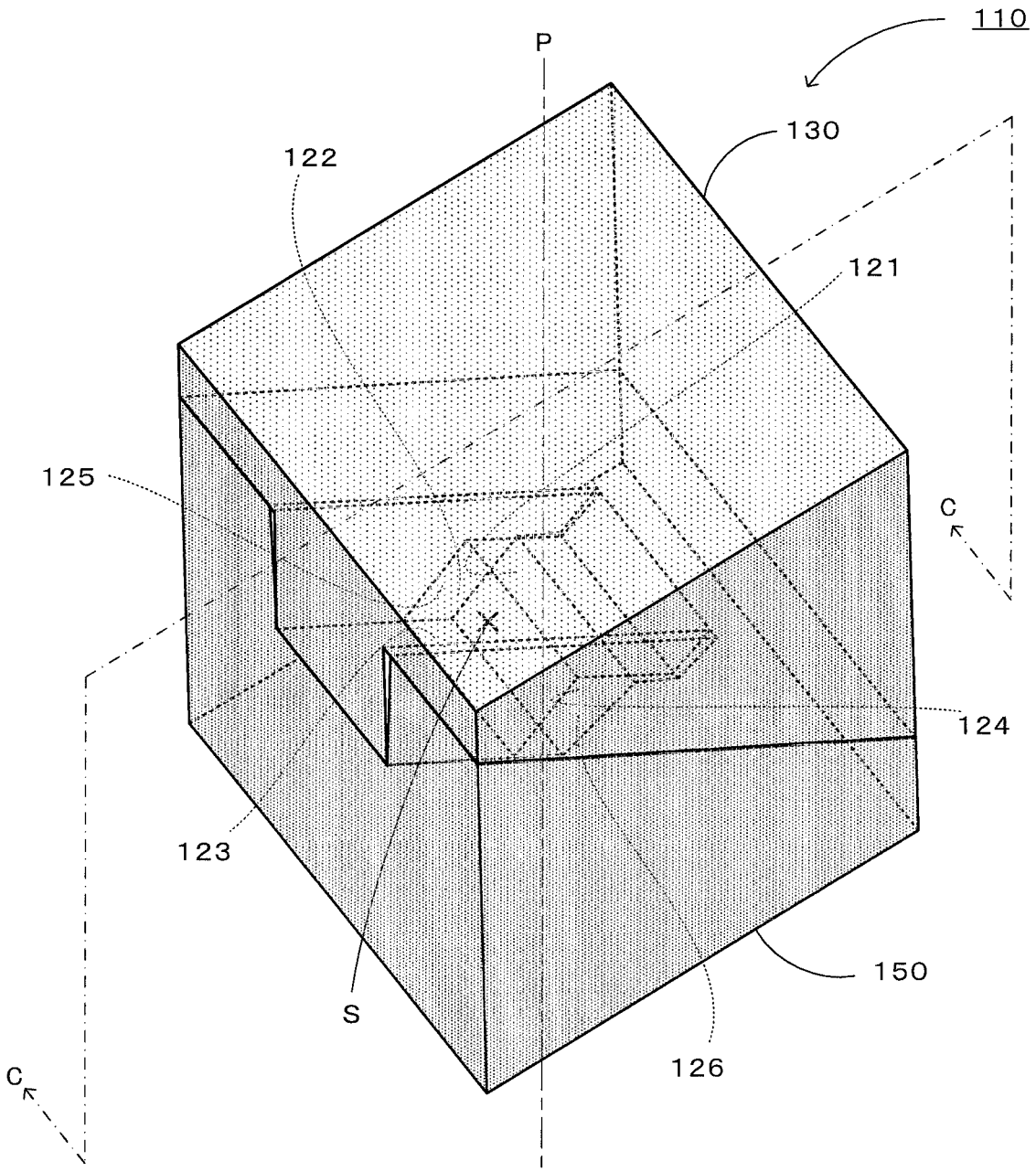
FIG. 8 is a perspective view of a forging tool 110.
Figure 9:
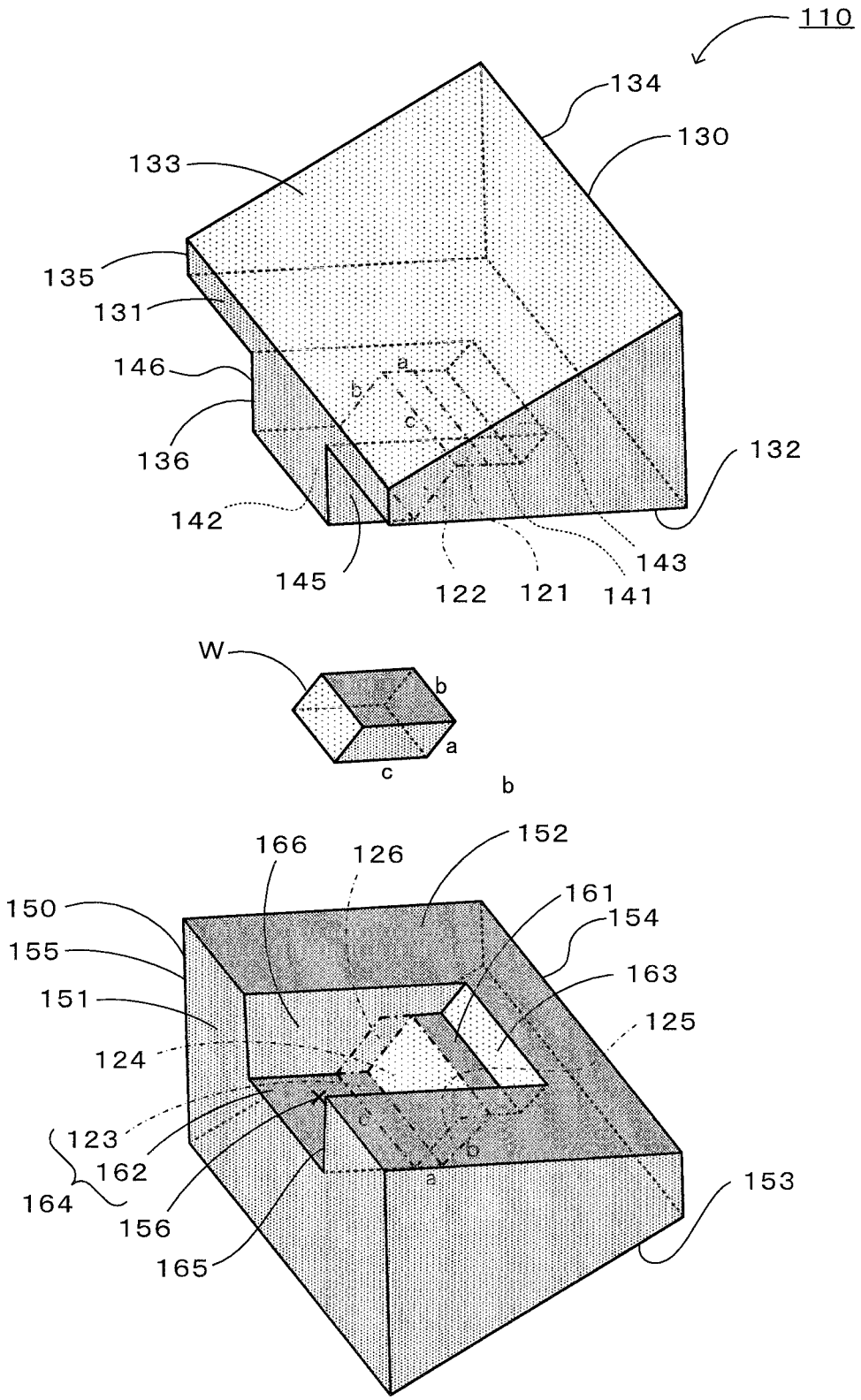
FIG. 9 is an exploded perspective view of the forging tool 110.
Figure 10:
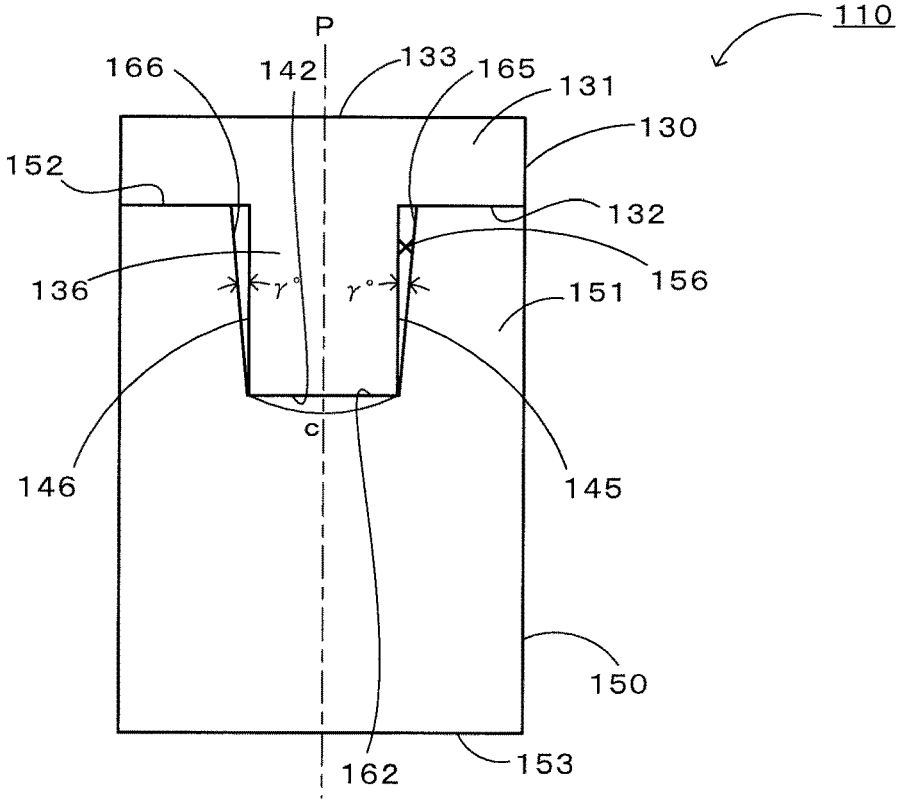
FIG. 10 is a front view of the forging tool 110.
Figure 11:
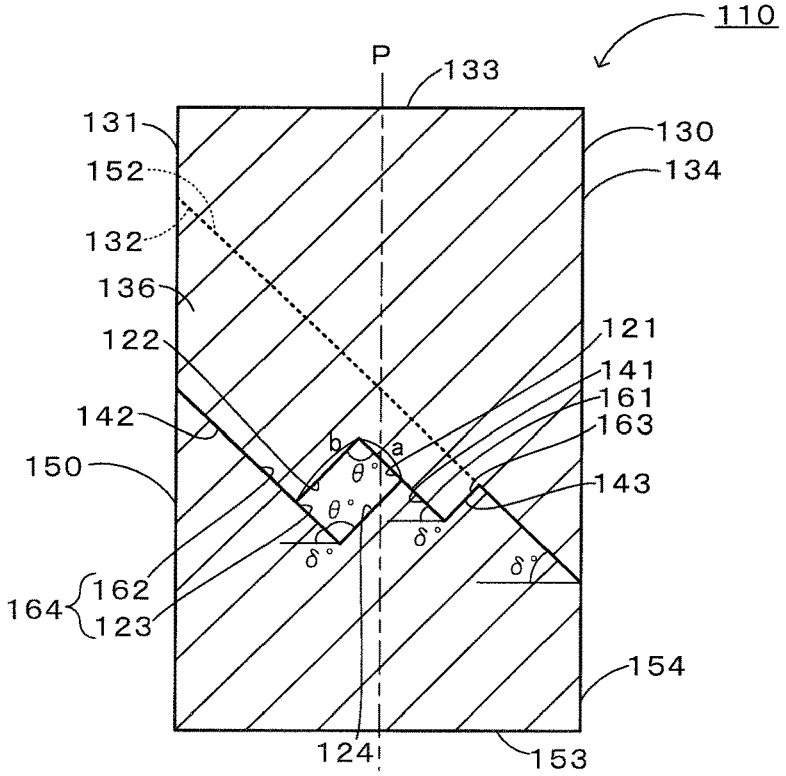
FIG. 11 is a sectional view of the forging tool 110 taken along line C-C illustrated in FIG. 8.
Figure 12:
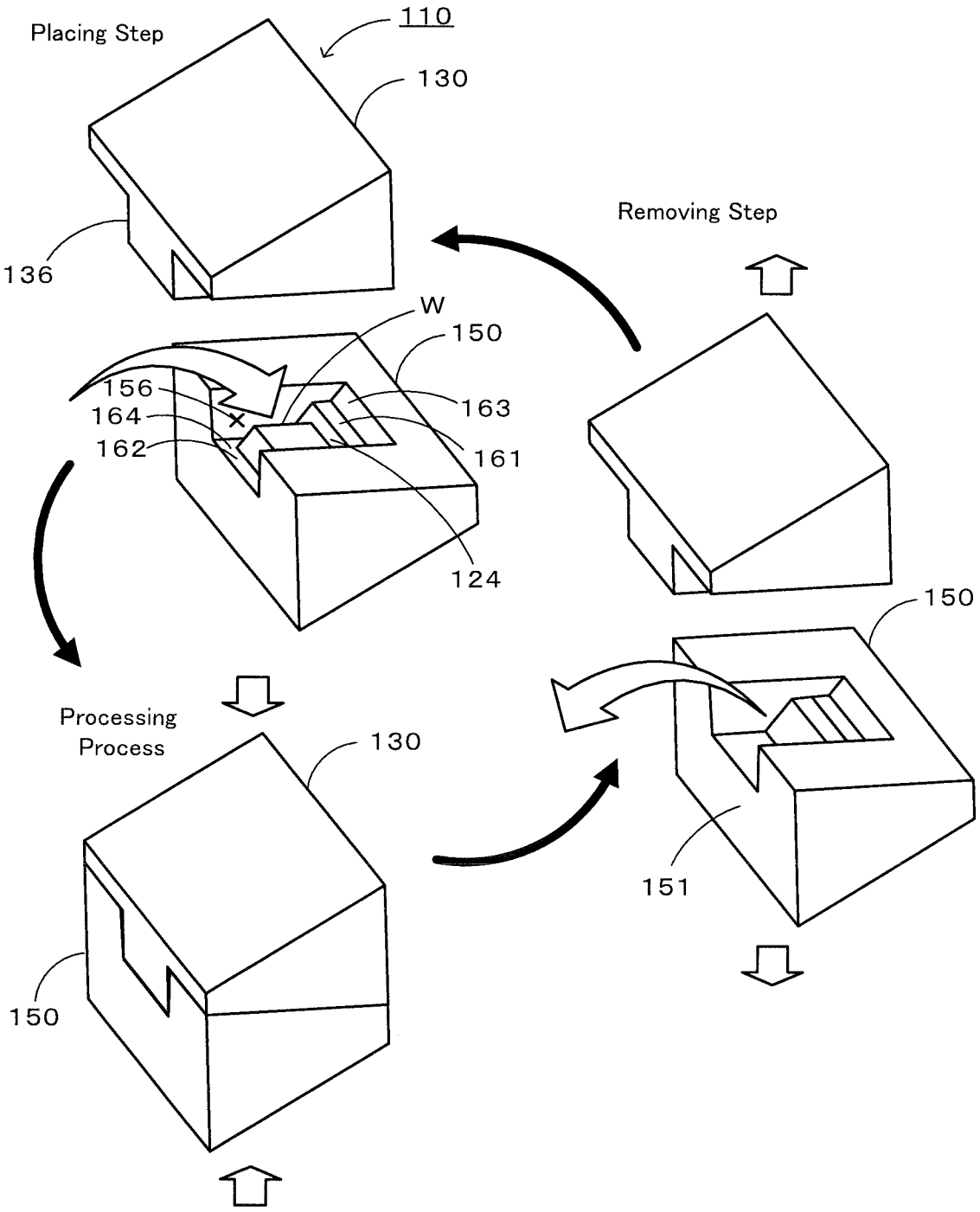
FIG. 12 is an explanatory view illustrating a method of forging with the forging tool 110.
Figure 13:
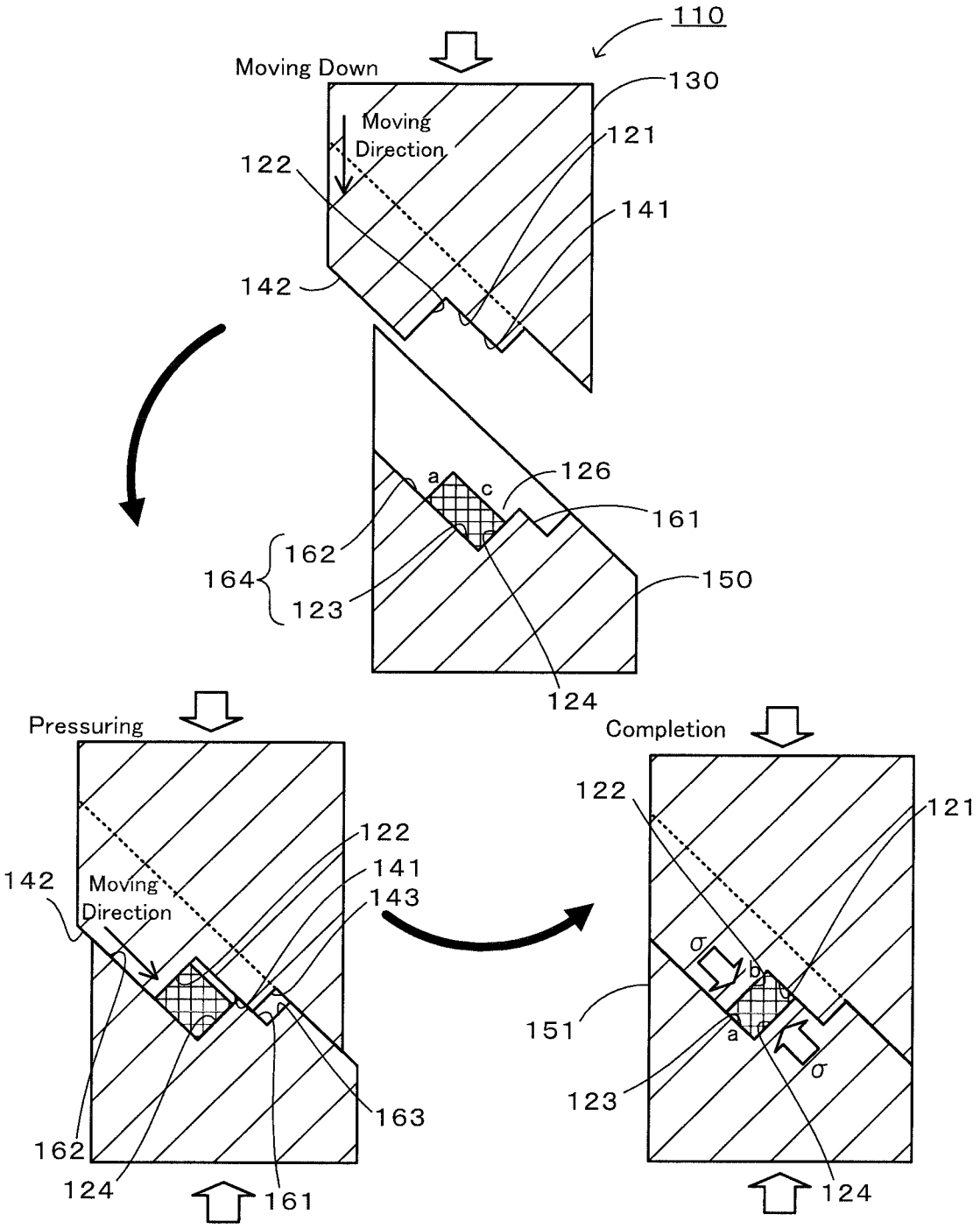
FIG. 13 is an explanatory view illustrating a processing step in the method of forging with the forging tool 110.

FIG. 8 is a perspective view of a forging tool 110 according to a second embodiment. FIG. 9 is an exploded perspective view of the forging tool 110 illustrated in FIG. 9. FIG. 10 is a front view of the forging tool 110. FIG. 11 is a sectional view of the forging tool 110 taken along line C-C illustrated in FIG. 8. FIG. 12 is an explanatory view illustrating a method of forging with the forging tool 110. FIG. 13 is an explanatory view illustrating a processing step in the method of forging with the forging tool 110. Although hidden lines are indicated by broken lines in the perspective views of FIGS. 8 and 9, a subset of broken lines are omitted. For ease of understanding of the structure, visible surfaces are shaded in FIGS. 8 and 9.

The forging tool 110 is used for so-called multi-axis forging in which plastic strain is sequentially added in the X, Y, Z axis directions of the workpiece W perpendicular to each other by forging to the workpiece W having a cuboidal shape. As illustrated in FIGS. 8 to 11, the forging tool 110 has a first wall surface 121, a second wall surface 122 adjacent to the first wall surface 121, a third wall surface 123 that faces the first wall surface 121 and is adjacent to the second wall surface 122, a fourth wall surface 124 that faces the second wall surface 122 and is adjacent to the first wall surface 121 and the third wall surface 123, a fifth wall surface 125 adjacent to the first to fourth wall surfaces 121 to 124, and a sixth wall surface 126 that faces the fifth wall surface 125 and is adjacent to the first to fourth wall surfaces 121 to 124. These first to sixth wall surfaces 121 to 126 form the cuboid-shaped forging space S. The workpiece W is forged in this forging space S of the forging tool 110. In FIG. 9, the outlines of the first to sixth wall surfaces 121 to 126 are indicated by dotted chain lines.

The forging tool 110 includes a first die 130 and a second die 150. These dies may be formed of, for example, alloy tool steel examples of which include hot work tool steel such as hot work die steel (for example, SKD61) and cold work tool steel such as cold work die steel or a nickel based alloy such as Hastelloy (Hastelloy is a registered trademark). A load is applied in the direction of the axis P to the forging tool 110. The axis P of the forging tool 110 is coincident with the axis of the first die 130 and the axis of the second die 150.

The first die 130 is a member in which a projection having a stepped shape 136 projects from a bottom surface 132 of a main body portion 135. An upper surface 133 of the main body portion 135 is perpendicular to the axis P (loading direction) of the forging tool 110. The bottom surface 132 of the main body portion 135 is inclined such that the thickness of the main body portion 135 is greater on a rear surface 134 side than on a front surface 131 side. The projection 136 has a stepped shape in which the height from the bottom surface 132 of the main body portion 135 is higher on the front surface 131 side than on the rear surface 134 side. The projection 136 includes a second facing surface 142, the first wall surface 121, and a first mating surface 141. The second facing surface 142 is adjacent to the front surface 131. The first wall surface 121 has a smaller height than the height of the second facing surface 142 and is parallel to the second facing surface 142. The first mating surface 141 is coplanar with and continuous with the first wall surface 121. The second facing surface 142 and the first wall surface 121 are connected to each other through the second wall surface 122. The first mating surface 141 and the bottom surface 132 of the main body portion 135 are connected to each other through a first die contact surface 143. The projection 136 is formed such that an angle formed between the first wall surface 121 and the second wall surface 122 is θ° that is greater than or equal to 90° (see FIG. 11). Preferably, θ° is greater than 90° but not greater than 95°, more preferably greater than or equal to 90.5° but not greater than 94°, and further more preferably greater than or equal to 91° but not greater than 93°. When θ° is greater than or equal to 90°, the workpiece W is more easily removed. When θ° is not greater than 95°, the workpiece is processed into a shape close to a cuboid in a strict sense. This allows stable placement of the workpiece for the next forging after the previous forging. Side surfaces 145 and 146 of the projection 136 are parallel to the axis P and parallel to each other. Furthermore, the projection 136 is formed such that the distance (width) between the side surface 145 and the side surface 146 is c, the length of the first wall surface 121 is a in C-C section, and the length of the second wall surface 122 is b in C-C section (here, $a<b<c$). The lengths of a, b, and c are the same as those according to the first embodiment. The first wall surface 121, the first mating surface 141, the second facing surface 142, and the bottom surface 132 are parallel to each other, and all of these are inclined relative to a plane perpendicular to the axis P by δ° (see FIG. 11). Preferably, δ° is greater than or equal to 45° but not greater than 75°. When this angle is greater than or equal to 45°, a load applied to the forging tool 110 is more sufficiently transferred to the workpiece W, and when this angle is not greater than 75°, the likelihood of the first die 130 and the second die 150 becoming out of alignment is further reduced.

The second die 150 is a member in which a recess 156 having a stepped shape is provided in an upper surface 152 of a main body portion 155. A bottom surface 153 of the main body portion 155 is perpendicular to the axis P. The upper surface 152 of the main body portion 155 is inclined such that the thickness of the main body portion 155 is greater on a front surface 151 side than on a rear surface 154 side. The recess 156 has a first side surface 165 and a second side surface 166. The first side surface 165 rises from one end of a bottom surface 164 formed by a second mating surface 162 and the third wall surface 123 so as to form the fifth wall surface 125. The second side surface 166 rises from the other end of the bottom surface 164 so as to form the sixth wall surface 126. The second mating surface 162 is coplanar with and continuous with the third wall surface 123. The first side surface 165 is inclined by an angle of γ° relative to a plane rising from the one end of the bottom surface 164 in a direction parallel to the axis P (see FIG. 10). The second side surface 166 is inclined by an angle of γ° relative to a plane rising from the other end of the bottom surface 164 in a direction parallel to the axis P. Preferably, γ° is not greater than 10°, and more preferably greater than or equal to 1° but not greater than 10°. When γ° is greater than or equal to 1°, the workpiece W is more easily removed. When γ° is not greater than 10°, the workpiece can be processed into a shape close to a cuboid in a strict sense. The recess 156 has a stepped shape in which the depth (depth from the upper surface 152) is greater on the front surface 151 side than on the rear surface 154 side. The recess 156 includes the bottom surface 164 and a first facing surface 161. The bottom surface 164 is adjacent to the front surface 151. The first facing surface 161 has a smaller depth than the depth of the bottom surface 164 and is parallel to the bottom surface 164. The bottom surface 164 and the first facing surface 161 are connected to each other through the fourth wall surface 124. The first mating surface 161 and the upper surface 152 of the main body portion 155 are connected to each other through a second die contact surface 163. The recess 156 is formed such that an angle formed between the third wall surface 123 and the fourth wall surface 124 is θ° that is greater than or equal to 90° (see FIG. 11). The value of θ° is the same as that of the first die 130. Furthermore, the recess 156 is formed such that the distance (width) between the first side surface 165 and the second side surface 166 is c on the second mating surface 162, the length of the third wall surface 123 is a in C-C section, and the length of the fourth wall surface 124 is b in C-C section (here, $a<b<c$). The lengths of a, b, and c are the same as those according to the first embodiment. The third wall surface 123, the first facing surface 161, the second mating surface 162, and the upper surface 152 are parallel to each other, and all of these are inclined relative to a plane perpendicular to the axis P by δ° (see FIG. 11). Preferably, δ° is greater than or equal to 45° but not greater than 75°. The second die 150 may include a plate member placed at the bottom surface 164 of the recess 156 so as to project to the front surface 151 side for allowing removal of the plate member, and a surface of this plate member may serve as the bottom surface 164 (the second mating surface 162 and the third wall surface 123). In this way, the workpiece W can be pulled out with the plate member, and accordingly, the workpiece W can be more easily removed.

Next, a method of performing multi-axis forging on the workpiece W with the forging tool 110 is described. As the workpiece W, a cuboid-shaped workpiece the lengths of the sides of which correspond to the values of a, b, and c (here, $a<b<c$) of the first and second dies 130, 150 described above is used. For example, titanium, a titanium alloy, copper, a copper alloy, a steel material such as stainless steel, an aluminum alloy, a magnesium alloy, or the like can be used as the workpiece W.

For example, as illustrated in FIGS. 12 and 13, this method of performing multi-axis forging includes a placing step, the processing step, and a removing step. The workpiece W having the first shape is placed on the bottom surface 164 of the second die 150 in the placing step. The placed workpiece W is changed into the second shape corresponding to the shape of the forging space S (see FIG. 8) so as to add plastic strain to the workpiece W in the processing process. The processed workpiece W is removed in the removing step. Steps from the placing step to the removing step may be repeated twice or more.

The workpiece W is placed on the bottom surface 164 of the second die 150 in the placing step. At this time, the workpiece W is placed such that the surfaces of the workpiece W surrounded by the sides having lengths of b and c face the first and third wall surfaces 121, 123 surrounded by the sides having lengths of a and c, the surfaces of the workpiece W surrounded by the sides having lengths of a and b face the second and fourth wall surfaces 122, 124 surrounded by the sides having lengths of b and c, and the surfaces of the workpiece W surrounded by the sides having lengths of a and c face the fifth and sixth wall surfaces 125, 126 surrounded by the sides having lengths of a and b (see FIG. 9).

As illustrated in FIGS. 12 and 13, in the processing step, first, the first die 130 is moved down so as to insert the projection 136 of the first die 130 into the recess 156 of the second die 150. When the second facing surface 142 of the first die 130 is brought into contact with the second mating surface 162 of the second die, the second facing surface 142 slides along the second mating surface 162, and the first mating surface 141 slides along the first facing surface 161. Furthermore, when the second wall surface 122 of the first die 130 is brought into contact with the workpiece W, the workpiece W is pressed between the second wall surface 122 and the fourth wall surface 124. This causes the workpiece W to be pressed by forces parallel to the first and second mating surfaces 141, 162 and the second and first facing surfaces 142, 161. Furthermore, when the pressure continues to be applied until the forging space S is formed by bringing the first die contact surface 143 of the first die 130 into contact with the second die contact surface 163 of the second die 150, a pressing step is completed. Thus, the workpiece W is changed into the second shape corresponding to the shape of the forging space S and assumes the following state. That is, the surfaces surrounded by the sides having the lengths of a and c face the first and third wall surfaces 121, 123, the surfaces surrounded by the sides having the lengths of b and c face the second and fourth wall surfaces 122, 124, and the surfaces surrounded by the sides having the lengths of a and b face the fifth and sixth wall surfaces 125, 126. In the processing step, when the load in the axis P direction is applied to the first die 130 and the second die 150, the second facing surface 142 moves along the second mating surface 162, and the first mating surface 141 moves along the first facing surface 161. Accordingly, a mechanism that makes such movement smooth may be provided between the first die 130 and a press machine that applies the load to the forging tool 110. For example, a roller, lubricating member, or the like may be provided between a pressing unit of the press machine and the first die 130.

In the removing step, the first die 130 is pulled up from the second die 150, and the workpiece W is removed. When removing the workpiece W, for example, the second die 150 may be rotated, so that the front surface 151 faces downward for the removal. In this way, the workpiece W drops to the front surface 151 side due to its own weight, and accordingly, the workpiece W can be easily removed.

Next, the removed workpiece W is rotated, and the steps from the placing step to the removing step are performed. These operations are repeated as many times as necessary. Thus, similarly to the case where the forging tool 10 is used, as illustrated in FIG. 7, plastic strain can be sequentially added in the X, Y, Z axis directions of the workpiece W perpendicular to each other by forging.

In the forging tool 110 described above, when the load is applied to the first die 130 and the second die 150, the second facing surface 142 moves along the second mating surface 162, the first mating surface 141 moves along the first facing surface 161, and the first die contact surface 143 and the second die contact surface 163 are brought into contact with each other so as to form the forging space S. Thus, the likelihood of the occurrences of misalignment is reduced when the workpiece W is pressed. This can suppress damage to the forging tool 110 and an increase in difficulty in removing the workpiece W due to misalignment. Furthermore, out of the four sides around the workpiece W, the first and second wall surfaces 121, 122 adjacent to each other are provided in the first die 130 and the third and fourth wall surfaces 123, 124 adjacent to each other are provided in the second die 150. Thus, the workpiece W applies to the first and second dies 130, 150 forces in directions in which the first and second dies 130, 150 are separated from each other. Thus, the workpiece W can be easily removed from the first to fourth wall surfaces 121 to 124.

Furthermore, in the forging tool 110, the second die contact surface 163 is formed on a side of the first facing surface 161 opposite the fourth wall surface 124 so as to rise from the first facing surface 161, and the first die contact surface 143 is formed on a side of the first mating surface 141 opposite the first wall surface 121 so as to be brought into contact with the second die contact surface 163. For such a forging tool 110, in the manufacture of the forging tool 110, it is sufficient that the second facing surface 142, the second wall surface 122, the surface including the first wall surface 121 and the first mating surface 141, and the first die contact surface 143 be only formed into a stepped shape in the first die 130. Also, it is sufficient that the bottom surface 164 including the second mating surface 162 and the third wall surface 123, the fourth wall surface 124, the first facing surface 161, and the second die contact surface 163 be only formed into a stepped shape in the second die. Thus, the shape of the forging tool itself is not complex, and accordingly, the manufacture of the forging tool itself is easy and the forging tool itself is unlikely to be damaged.

In this forging tool 110, the second die 150 has the recess 156 that has the first side surface 165 and the second side surface 166. The first side surface 165 rises from the one end of the bottom surface 164 formed by the second mating surface 162 and the third wall surface 123 so as to form the fifth wall surface 125. The second side surface 166 rises from the other end of the bottom surface 164 so as to form the sixth wall surface 126. The first side surface 165 and the second side surface 166 are inclined such that the distance between the first side surface 165 and the second side surface 166 increases from the bottom surface 164 toward an opening of the recess 156. Since the opening side of the recess 156 is larger as described above, the workpiece W is more easily removed.

In this forging tool 110, the first and second mating surfaces 141, 162 and the first and second facing surfaces 161, 142 are inclined relative to a plane perpendicular to the loading direction (axis P of the forging tool 110) by an angle greater than or equal to 45° but not greater than 75°. Thus, the load applied to the forging tool is more sufficiently transferred to the workpiece W, and the likelihood of the first die 130 and the second die 150 becoming out of alignment is further reduced.

Of course, the present invention is not limited to the above-described embodiment in any way and can be embodied in a variety of forms without departing from the technical scope of the present invention.

For example, in the above-described forging tool 10, the third die 60 has the recess 65 that has a bottomed cylindrical shape. The recess 65 has the bottom surface 62 and the inner circumferential surface 64. The bottom surface 62 includes the contact surface 61. The inner circumferential surface 64 rises from the bottom surface 62. However, it is sufficient that the bottom surface 62 including the contact surface 61 be provided, and this may be a flat surface. Also, in the forging tool 10, the outer diameter of the bottom surface 62 of the recess 65 is coincident with the outer diameter of the bottom surface 52 of the cylindrical member 50. However, the outer diameter of the bottom surface 62 of the recess 65 may be greater than the outer diameter of the bottom surface 52 of the cylindrical member 50.

In the forging tool 10, the inner circumferential surface 64 of the third die 60 is inclined relative to the axis P by an angle of β° so as to be separated from the axis P from the bottom surface 62 toward the opening surface 63 opposite the bottom surface 62. However, the inner circumferential surface 64 is not necessarily inclined. That is, β° may be 0°. In this case, preferably, the outer circumferential surface 54 of the cylindrical member 50 is inclined relative to the axis P so as to approach the axis P from the bottom surface 52 toward the upper surface 53. Preferably, this inclination is greater than 0° but not greater than 45°, and more preferably greater than or equal to 3° but not greater than 10°. In this way, the cylindrical member 50 and the first and second dies 30, 40 are more easily removed from the third die 60. As a result, the workpiece W can be more easily removed.

In the forging tool 10, the cylindrical member 50 has a cylindrical shape the outer circumferential surface 54 of which is parallel to the axis P in FIGS. 1 to 6. However, the outer circumferential surface 54 is not necessarily parallel to the axis P. For example, the cylindrical member 50 may have a guide surface at an outer circumference of the bottom surface 52 thereof. The guide surface faces and is brought into contact with the inner circumferential surface 64 of the third die 60 when the guide surface is brought into contact with the contact surface 61 of the third die 60. In this way, the cylindrical member 50 is inserted into the recess of the third die 60 while being guided by the inner circumferential surface 64 of the third die 60. This can further suppress misalignment. For example, not only the bottom surface 52 side of the outer circumferential surface 54 but also the entirety of the outer circumferential surface 54 may be inclined so as to face and be brought into contact with the inner circumferential surface 64 of the third die 60 or so as to reduced the diameter of the outer circumferential surface 54 from the bottom surface 52 toward the upper surface 53.

In the forging tool 10, the first and second dies 30, 40 and the cylindrical member 50 are secured by using the bottomed holes 37, 47 provided in the first and second dies 30, 40, the through holes 57 provided in the cylindrical member 50, and the bolts 58. However, the securing of the first and second dies 30, 40 and the cylindrical member 50 is not limited to the method as described above. For example, through holes may be provided in the first and second dies 30, 40. In this case, a bar-shaped member is inserted through these through holes and the through holes 57 of the cylindrical member. The first and second dies 30, 40 and the cylindrical member 50 may be secured by other forms or these may be omitted.

In the forging tool 10, although the first and second dies 30, 40 are combined with each other so as to form the frustocone, the shape formed by the combination of the first and second dies 30, 40 may be any of frustum shapes.

However, the frustocone is preferable because of ease of removal from the cylindrical member 50.

In the forging tool 10, the recess 35 is formed such that the depth from the bottom surface 32 is a, the width of the first wall surface 21 is b, and the width of the second wall surface 22 is c. However, the recess 35 may be formed such that the depth from the bottom surface 32 is a, the width of the first wall surface 21 is c, and the width of the second wall surface 22 is b. In this case, the recess 45 is formed such that the depth from the bottom surface 42 is a, the width of the third wall surface 23 is c, and the width of the fourth wall surface 24 is b.

Although the forging tool 10 includes the cylindrical member 50, the cylindrical member 50 may be omitted. In this case, the first die 30 and the second die 40 may be members formed so as to become, when combined with each other, a frustocone in which the forging space S opens into a central portion of a bottom surface formed by the bottom surface 32 of the first die 30 and the bottom surface 42 of the second die 40, and the third die 60 may be formed so as to have the bottomed cylindrical recess 65 that has the bottom surface 62 including the contact surface 61 and the inner circumferential surface 64 rising from the bottom surface 62 and that has a bottom the outer diameter of which is coincident with the outer diameter of the bottom surfaces 32, 42 of the frustocone. In this way, when the workpiece W is pressed, separation of the first die 30 and the second die 40 from each other can be suppressed by the recess 65 of the third die 60. In addition, since the cylindrical member 50 is not provided, when the workpiece W is removed, the first die 30 and the second die 40 are more easily separated from each other, and the workpiece W is easily removed.

In the forging tool 10 with the cylindrical member 50 omitted, the inner circumferential surface 64 of the third die 60 may be inclined so as to be separated from the axis P from the bottom surface 62 toward the opening surface 63 opposite the bottom surface 62. In this way, the first and second dies 30, 40 are more easily removed from the third die 60. As a result, the workpiece can be more easily removed. In this forging tool 10, the inner circumferential surface 64 of the third die 60 is preferably inclined relative to the axis P by an angle not greater than 10°, and more preferably inclined relative to the axis P by an angle greater than or equal to 0.5° but not greater than 10°. When this angle is greater than or equal to 0.5°, the first and second dies 30, 40 are more easily removed from the third die 60. Setting this angle to an angle not greater than 10° can further suppress separation of the first die 30 and the second die 40 from each other when the workpiece W is pressed. In this forging tool 10, guide surfaces may be provided at outer circumferences of the bottom surfaces 32, 42 of the frustocone. The guide surfaces face and are brought into contact with the inner circumferential surface 64 of the third die 60 when the guide surface is brought into contact with the contact surface 61 of the third die 60. In this way, the frustocone is inserted into the recess 65 of the third die 60 while being guided by the inner circumferential surface of the third die 60. This can further suppress misalignment. In this forging tool 10, the columnar body formed by combining the first die 30 and the second die 40 with each other is not necessarily a frustocone. Also in this forging tool 10, the outer circumferential surfaces 34, 44 of this columnar body are not necessarily inclined or may be inclined so as to be separated from the axis P of the forging tool 10 from the bottom surfaces 32, 42 toward the upper surfaces 33, 43.

Figure 14:
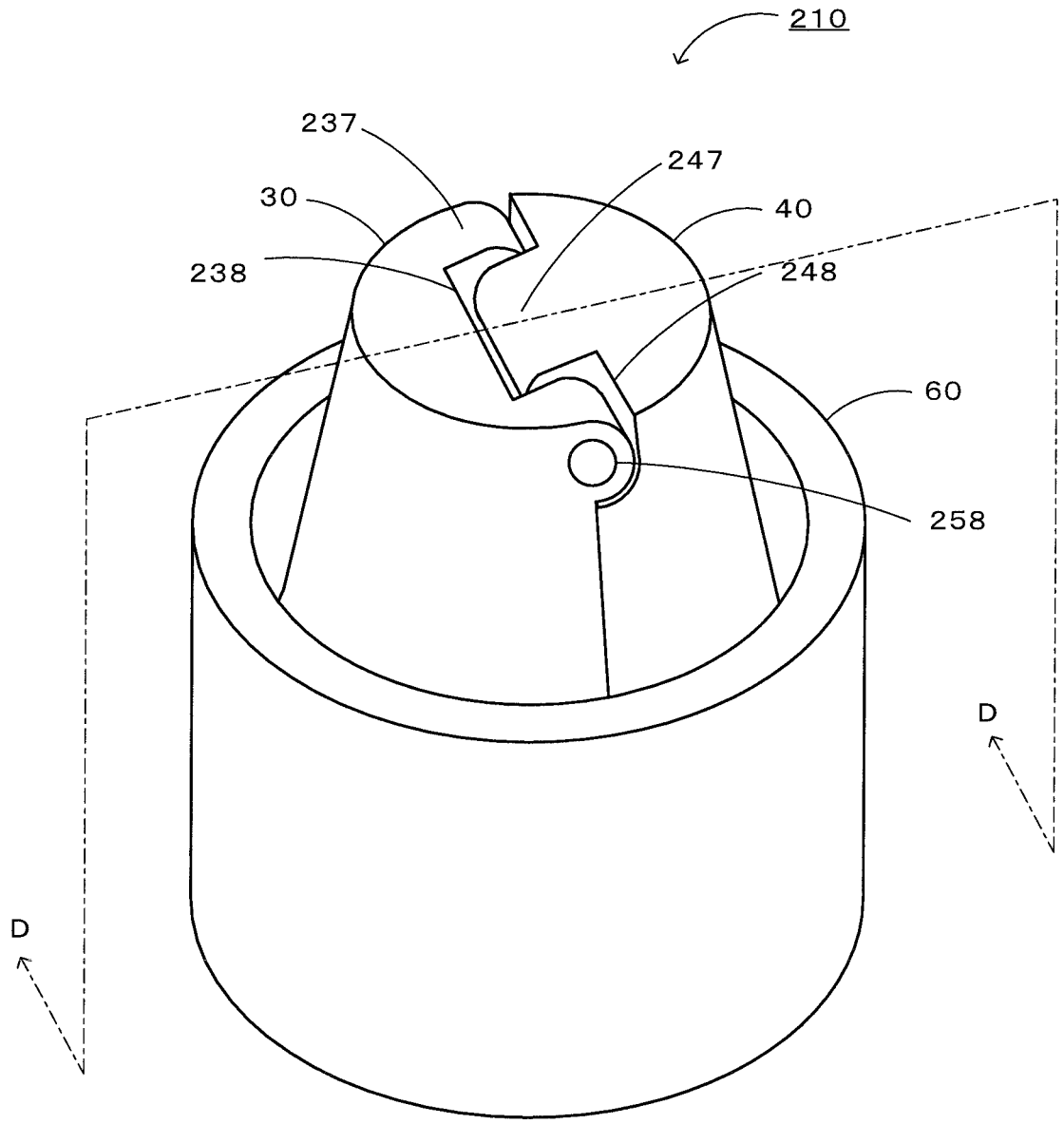
FIG. 14 is a perspective view of a forging tool 210.
Figure 15:
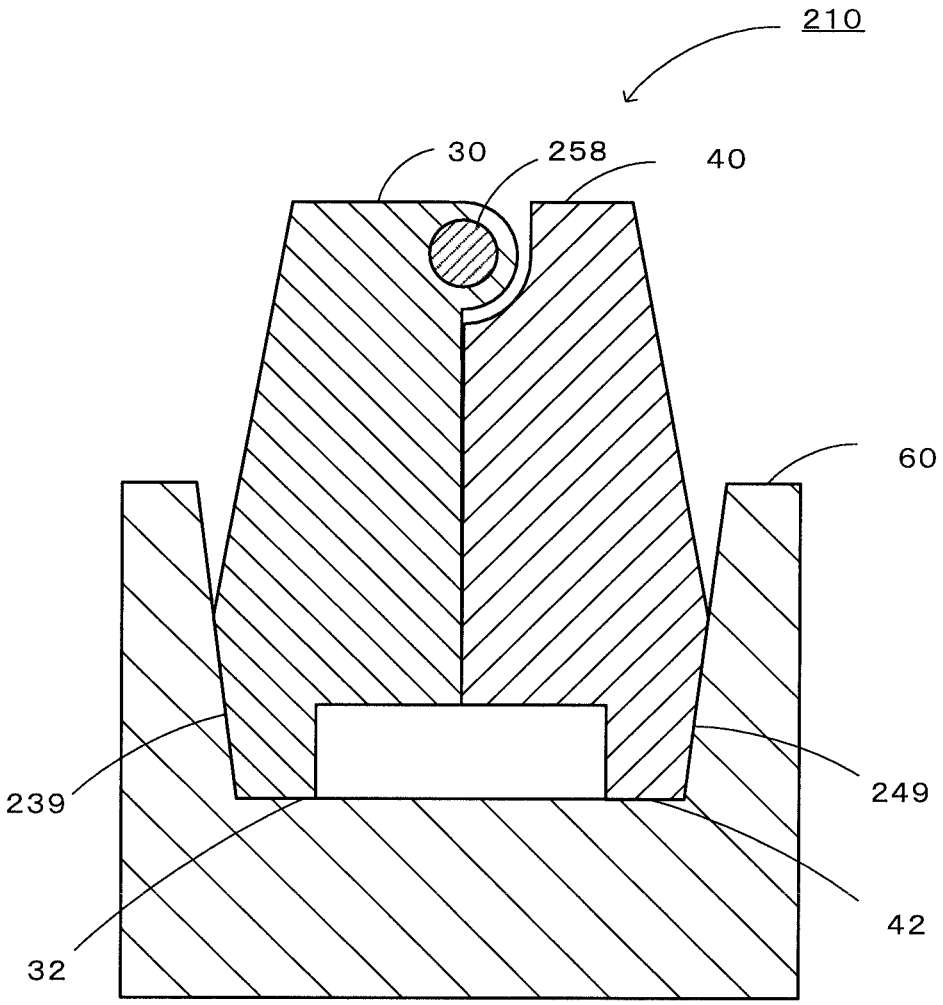
FIG. 15 is a sectional view of the forging tool 210 taken along line D-D illustrated in FIG. 14.
Figure 16:
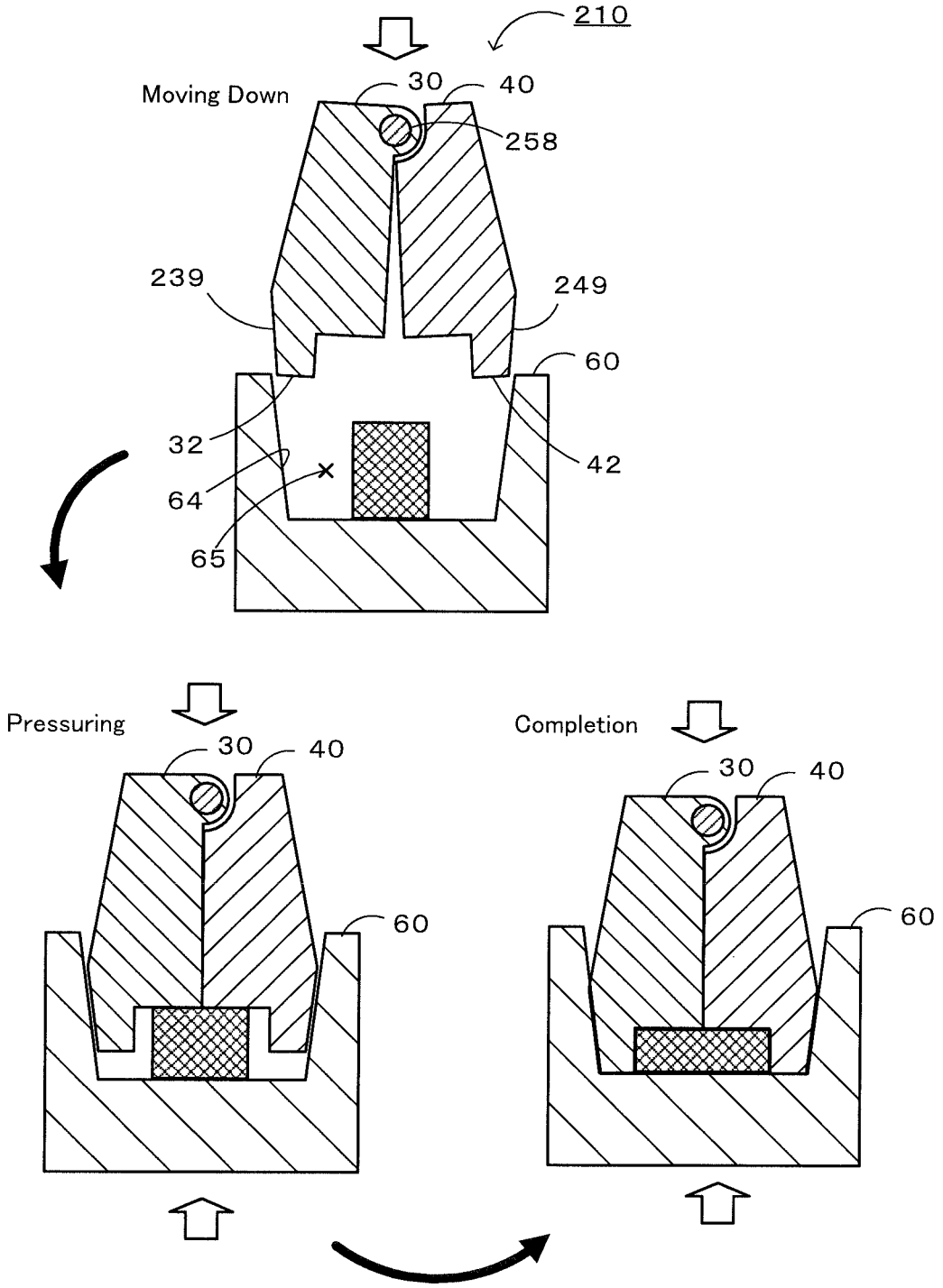
FIG. 16 is an explanatory view of a processing step in the method of forging with the forging tool 210.

A forging tool 210 that is an example of the forging tool 10 with the cylindrical member 50 omitted is described below with reference to the drawings. FIG. 14 is a perspective view of the forging tool 210. FIG. 15 is a sectional view of the forging tool 210 taken along line D-D illustrated in FIG. 14. FIG. 16 is an explanatory view illustrating states of a processing step with the forging tool 210. This forging tool 210 is the same as the forging tool 10 other than the following points: the cylindrical member 50 is omitted; in the first and second dies 30, 40, overhang portions 237, 247 and receiving portions 238, 248 are added and the surfaces 36, 46 and the bottomed holes 37, 47 are omitted; the first die 30 and second die 40 are secured to each other by a shaft member 258 instead of the bolts 58; guide surfaces 239, 249 are provided at the outer circumferences of the bottom surfaces 32, 42 of the frustocone. The guide surfaces 239, 249 face and are brought into contact with the inner circumferential surface 64 of the third die 60 when the guide surfaces 239, 249 are brought into contact with the contact surface 61 of the third die 60. In this forging tool 210, the overhang portion 247 of the second die 40 is disposed in the receiving portion 238 of the first die 30 and the overhang portions 237 of the first die 30 are disposed in the receiving portions 248 of the second die 40 such that the axes of holes provided in the overhang portions 237, 247 are coincident with each other. The first die 30 and the second die 40 are secured to each other by a hinge structure formed by inserting the shaft member 258 into these holes. When this forging tool 210 is used, as illustrated in FIG. 16, in the processing step, the first die 30 and the second die 40 secured to each other by the shaft member 258 can be inserted into the recess 65 of the third die 60 with the bottom surfaces 32, 42 comparatively largely separated from each other, and, from this state, the first and second dies 30, 40 can be moved down while the guide surfaces 239, 249 of the first and second dies 30, 40 are moved along the inner circumferential surface 64 of the third die 60. Thus, the likelihood of the occurrences of misalignment or the like is further reduced. Although the first die 30 and the second die 40 are secured to each other by the hinge structure in the forging tool 210, the first die 30 and the second die 40 may be secured to each other by any method or the first die 30 and the second die 40 are not necessarily secured to each other. This hinge structure may be applied to the forging tool 10.

For example, in the forging tool 110, the second die contact surface 163 is formed on the side of the first facing surface 161 opposite the fourth wall surface 124 so as to rise from the first facing surface 161, and the first die contact surface 143 is formed on the side of the first mating surface 141 opposite the first wall surface 121 so as to be brought into contact with the second die contact surface 163. However, as long as the first die contact surface 143 and the second die contact surface 163 are formed at such positions that the forging space S is formed when the first die contact surface 143 and the second die contact surface 163 are brought into contact with each other, the first die contact surface 143 and the second die contact surface 163 are not limited to the above description.

In the forging tool 110, although the first side surface 165 and the second side surface 166 of the recess 156 of the second die 150 are inclined such that the distance between the first side surface 165 and the second side surface 166 increases from the bottom surface 164 toward an opening of the recess 156, the first side surface 165 or the second side surface 166 are not necessarily inclined. In this case, it is sufficient that the side surfaces 145, 146 of the projection 136 of the first die 130 be formed to have such dimensions that the side surfaces 145, 146 are not got stuck in by the first and second side surfaces 165, 166 of the second die 150.

In the forging tool 110, the projection 136 is formed such that the distance between the side surface 145 and the side surface 146 is c, the length of the first wall surface 121 is a in C-C section, and the length of the second wall surface 122 is b in C-C section. However, the formation of the projection 136 is not limited to the above description. The projection 136 may be formed such that the distance between the side surface 145 and the side surface 146 is b, the length of the first wall surface 121 is a in C-C section, and the length of the second wall surface 122 is c in C-C section. In this case, the recess 156 is formed such that the distance between the first side surface 165 and the second side surface 166 is b in the second mating surface 162, the length of the third wall surface 123 is a in C-C section, and the length of the fourth wall surface 124 is c in C-C section.

In the forging tool 110, the first wall surface 121 or the like and the bottom surface 132 are parallel to each other and the third wall surface 123 or the like and the upper surface 152 are parallel to each other. However, the first wall surface 121 or the like and the bottom surface 132 are not necessarily parallel to each other, and the third wall surface 123 or the like and the upper surface 152 are not necessarily parallel to each other.

EXAMPLES

Hereafter, instances in which the multi-axis forging was performed with the forging tool 10 are described as EXAMPLES.

Example 1

A Cu-7 mass % Al alloy the stacking fault energy (SFE) of which is 1.7 $mJm^{-2}$ was cut out into a piece having dimensions of 15.1 mm×18.4 mm×22.7 mm, and this piece was used as a workpiece of EXAMPLE 1. Multi-axis forging was performed on this workpiece with the forging tool 10. In the multi-axis forging, the steps from the placing step to the removing step were repeated 15 times. In each of the processing steps, compressive deformation of true strain (or cumulative strain) of 6.0 was added at an initial strain rate of $3.0\times10^{-3}s^{-1}$. A tensile test piece having a gage section size of 6 mm×3 mm×1 mm was cut out from the processed workpiece every time the processing step was performed and subjected to tensile testing.

Examples 2, 3

Testing of EXAMPLE 2 was performed similarly to that of EXAMPLE 1 other than use of Cu-5 mass % Al alloy the stacking fault energy of which is 2.8 $mJm^{-2}$. Testing of EXAMPLE 3 was performed similarly to that of EXAMPLE 1 other than use of Cu-2 mass % Al alloy the stacking fault energy of which is 22.0 $mJm^{-2}$.

[Experimental Results]

Figure 17:
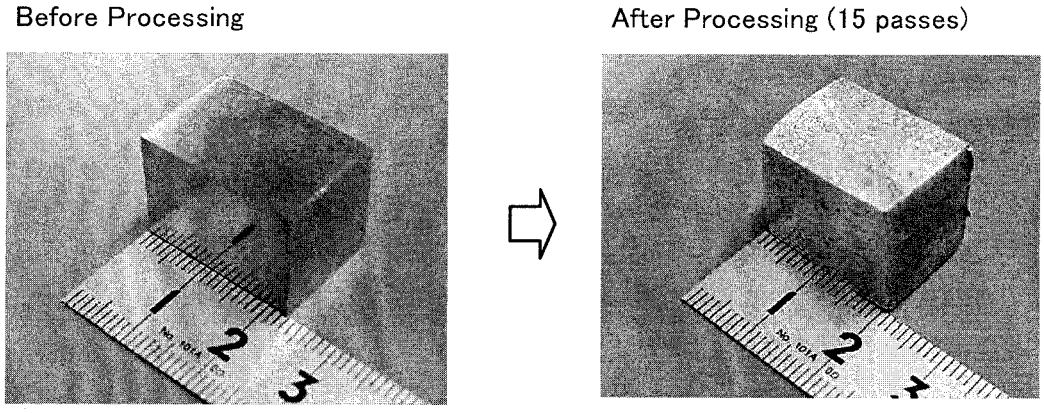
FIG. 17 includes photographs of the appearances of a workpiece of EXAMPLE 1 before and after processing.

In each of EXAMPLES 1 to 3, the forging tool 10 was not damaged or a situation in which the workpiece W could not be removed did not occur. FIG. 17 illustrates photographs of the appearances of the workpiece of EXAMPLE 1 before and after the processing. As the number of times of the forging increases, springback of the workpiece tends to increase. In FIG. 17, the shape is slightly different from a desired shape. This characteristic varies depending on the material. In EXAMPLES 1 to 3, large deformation indicating, for example, concentration of load was not observed. From the above-described results, it has been verified that the workpiece is easily removed and the forging tool itself is unlikely to be damaged when the forging tool 10 is used.

Figure 18:
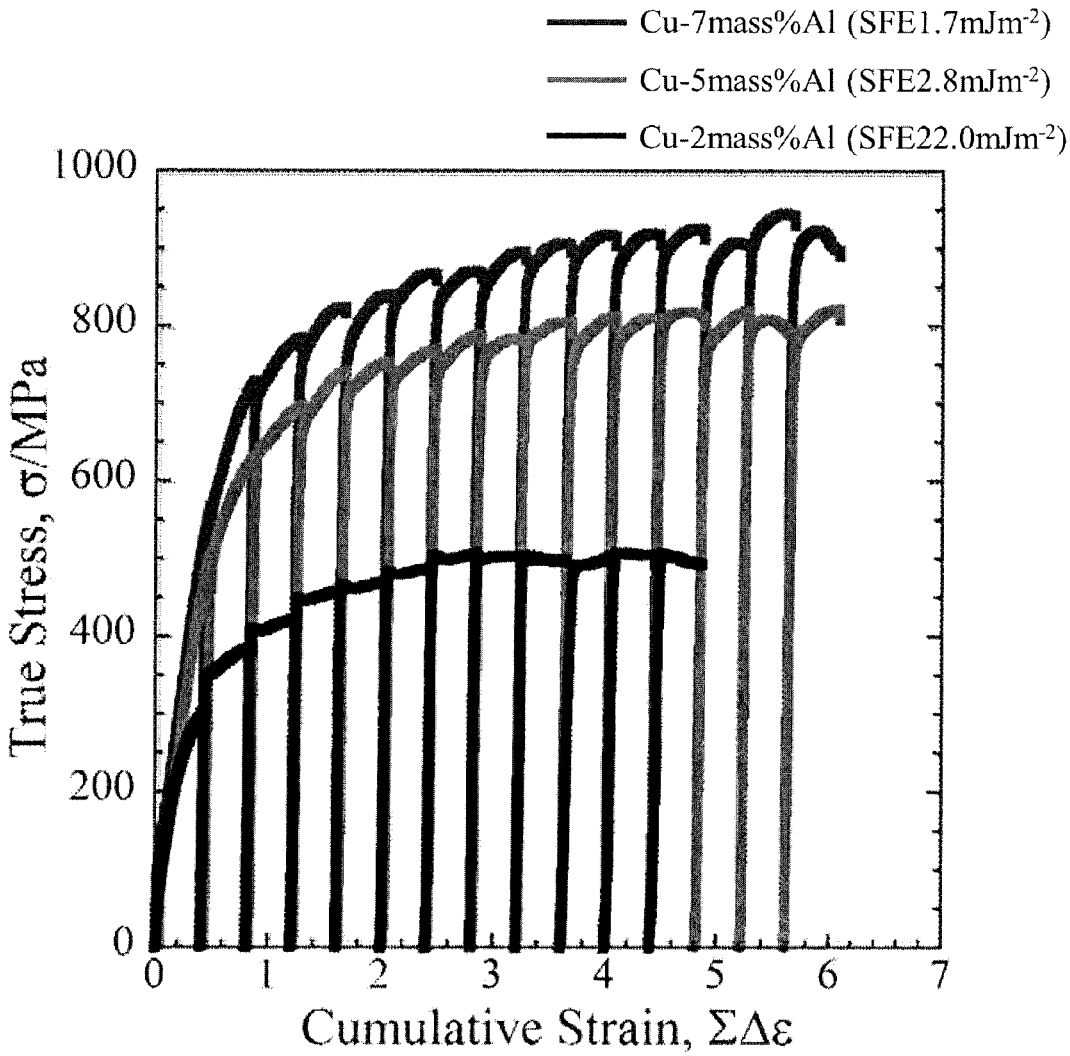
FIG. 18 provides tensile test results of EXAMPLES 1 to 3.

FIG. 18 illustrates tensile test results of EXAMPLES 1 to 3. In EXAMPLES 1 to 3, every time the steps from the placing step to the removing step are repeated, tensile yield strength is improved. For an annealed material, the strength of a Cu-7 mass % Al of a tensile yield strength of about 100 MPa can be increased to about 800 MPa. When the crystal structure is checked, the crystal particle size is reduced to a size not greater than 200 nm in each of the EXAMPLES 1 to 3. Thus, it has been understood that the forging tool 10 is useful as a forging tool for multi-axis forging.

Example 4

Stainless steel (SUS304) was cut out into a piece having dimensions of 15 mm×18.3 mm×22.5 mm, and this piece was used as a workpiece of EXAMPLE 4. Multi-axis forging was performed on this workpiece with the forging tool 10. In the multi-axis forging, the steps from the placing step to the removing step were repeated three times. In each of the processing steps, compressive deformation of true strain (or cumulative strain) of 1.2 was added at an initial strain rate of $3.0\times10^{-3}$ $s^{-1}$. Then, after the steps had been repeated three times, the appearance was checked. Also, tensile testing was performed similarly to EXAMPLE 1.

Figure 19:
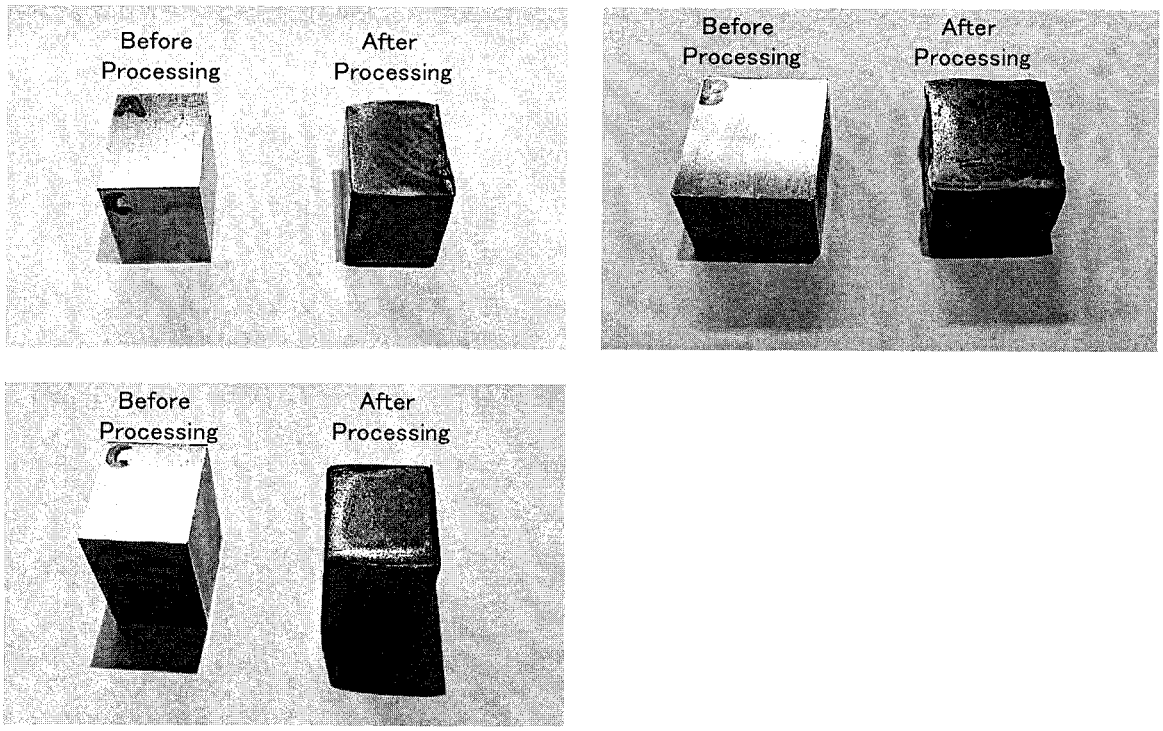
FIG. 19 includes photographs of the appearances of a workpiece of EXAMPLE 4 before and after processing.

Also in EXAMPLE 4, the forging tool 10 was not damaged or a situation in which the workpiece W could not be removed did not occur. FIG. 19 illustrates photographs of the appearances of the workpiece of EXAMPLE 4 before and after the processing. FIG. 19 illustrates three appearances in different observation directions. As illustrated in FIG. 19, also when stainless steel is used, although slight deformation is observed, large deformation indicating, for example, concentration of load is not observed. Also from these results, it has been verified that the workpiece is easily removed and the forging tool itself is unlikely to be damaged when the forging tool 10 is used. Also in EXAMPLE 4, every time the steps from the placing step to the removing step are repeated, tensile yield strength is improved. For an annealed material, the strength of SUS304 of a tensile yield strength of about 200 MPa can be increased to about 1.5 GPa.

The present application claims priority from Japanese Patent Application No. 2018-062494, filed on Mar. 28, 2018, the entire contents of which are incorporated herein by reference.

What is claimed is:

1. A forging tool, wherein the forging tool is used to forge a workpiece in a cuboidal forging space by using a first wall surface, a second wall surface adjacent to the first wall surface, a third wall surface that faces the first wall surface and is adjacent to the second wall surface, a fourth wall surface that faces the second wall surface and is adjacent to the first wall surface and the third wall surface, a fifth wall surface adjacent to the first to fourth wall surfaces, and a sixth wall surface that faces the fifth wall surface and is adjacent to the first to fourth wall surfaces, wherein the forging tool at least includes a first die that forms the first wall surface and the second wall surface, and a second die that forms the third wall surface and the fourth wall surface, and wherein the forging tool satisfies (a): the forging tool further includes, in addition to the first die and the second die, a third die that forms the sixth wall surface in a region surrounded by a contact surface when a bottom surface of the first die and a bottom surface of the second die are brought into contact with the contact surface; the first die forms a triangular region two sides of which are, of the fifth wall surface, a line of intersection of the first wall surface and the fifth wall surface and a line of intersection of the second wall surface and the fifth wall surface; the second die forms a triangular region two sides of which are, of the fifth wall surface, a line of intersection of the third wall surface and the fifth wall surface and a line of intersection of the fourth wall surface and the fifth wall surface; the workpiece is pressed between the fifth wall surface and the sixth wall surface; and the forging space is formed when the bottom surface of the first die and the bottom surface of the second die are brought into contact with the contact surface of the third die, or (b): the second die forms the fifth wall surface and the sixth wall surface; the first die has a first mating surface coplanar with the first wall surface and continuous with the first wall surface; the second die has a first facing surface that faces the first mating surface and that is brought into contact with the first mating surface; the second die further has a second mating surface coplanar with the third wall surface and continuous with the third wall surface; the first die has a second facing surface that faces the second mating surface and that is brought into contact with the second mating surface; the first facing surface, the second facing surface, the first mating surface, and the second mating surface are inclined relative to a plane perpendicular to a direction of a load so as to allow the second facing surface to move along the second mating surface and the first mating surface to move along the first facing surface when the load is applied to the first die and the second die in an axial direction of the forging tool; the workpiece is pressed between the second wall surface and the fourth wall surface; and the forging space is formed when a first die contact surface provided in the first die and a second die contact surface provided in the second die are brought into contact with each other.

2. The forging tool according to claim 1, wherein an angle formed between the first wall surface and the second wall surface and an angle formed between the third wall surface and the fourth wall surface are greater than 90°.

3. The forging tool according to claim 1, wherein the forging tool further satisfies (a) such that the first die and the second die are members formed so as to become, when the first die and the second die are combined with each other, a columnar body in which the forging space opens into a bottom surface formed by the bottom surface of the first die and the bottom surface of the second die, wherein an outer circumferential surface of the columnar body is inclined so as to approach an axis of the forging tool from the bottom surface of the columnar body toward an upper surface opposite the bottom surface, and wherein the forging tool further includes a cylindrical member that is disposed at the outer circumferential surface of the columnar body which has a bottom surface formed to be flush with the bottom surface of the columnar body.

4. The forging tool according to claim 3, wherein the outer circumferential surface of the columnar body is inclined relative to the axis of the forging tool by an angle greater than or equal to 3° but not greater than 10°.

5. The forging tool according to claim 3, wherein the third die has a bottomed cylindrical recess that has a bottom surface including the contact surface and that has an inner circumferential surface rising from the bottom surface, and a diameter of the bottom surface of the recess is coincident with an outer diameter of the bottom surface of the cylindrical member.

6. The forging tool according to claim 5, wherein an inner circumferential surface of the third die is inclined so as to be separated from the axis of the forging tool from the bottom surface toward an opening surface opposite the bottom surface.

7. The forging tool according to claim 6, wherein the inner circumferential surface of the third die is inclined relative to the axis of the forging tool by an angle greater than or equal to 0.5° but not greater than 10°.

8. The forging tool according to claim 6, wherein the forging tool has a guide surface that is provided at an outer circumference of the bottom surface of the cylindrical member, and the guide surface faces the inner circumferential surface of the third die and is brought into contact with the inner circumferential surface of the third die when the guide surface is brought into contact with the contact surface of the third die.

9. The forging tool according to claim 1, wherein the forging tool further satisfies (a) such that the first die and the second die are members formed so as to become, when the first die and the second die are combined with each other, a columnar body in which the forging space opens into a bottom surface formed by the bottom surface of the first die and the bottom surface of the second die, and wherein the third die has a bottomed cylindrical recess that has a bottom surface including the contact surface and that has an inner circumferential surface rising from the bottom surface, and a diameter of the bottom surface of the recess is coincident with an outer diameter of the bottom surface of the columnar body.

10. The forging tool according to claim 9, wherein an inner circumferential surface of the third die is inclined so as to be separated from the axis of the forging tool from the bottom surface toward an opening surface opposite the bottom surface.

11. The forging tool according to claim 10, wherein the inner circumferential surface of the third die is inclined relative to the axis of the forging tool by an angle greater than or equal to 0.5° but not greater than 10°.

12. The forging tool according to claim 10, wherein the forging tool has a guide surface that is provided at an outer circumference of the bottom surface of the columnar body, and the guide surface faces the inner circumferential surface of the third die and is brought into contact with the inner circumferential surface of the third die when the guide surface is brought into contact with the contact surface of the third die.

13. The forging tool according to claim 1, wherein the forging tool further satisfies (b) such that the second die contact surface is formed on a side of the first facing surface opposite the fourth wall surface so as to rise from the first facing surface, and wherein the first die contact surface is formed on a side of the first mating surface opposite the first wall surface so as to be brought into contact with the second die contact surface.

14. The forging tool according to claim 13, wherein the second die has a recess that has a first side surface which rises from one end of a bottom surface formed by the second mating surface and the third wall surface and which forms the fifth wall surface, and a second side surface which rises from another end of the bottom surface and which forms the sixth wall surface, and wherein the first side surface and the second side surface are inclined such that a distance between the first side surface and the second side surface increases from the bottom surface toward an opening of the recess.

15. The forging tool according to claim 14, wherein the first side surface is inclined by an angle greater than or equal to 1° but not greater than 10° relative to a plane that rises from the one end of the bottom surface and that is parallel to the axis of the forging tool, and the second side surface is inclined by an angle greater than or equal to 1° but not greater than 10° relative to a plane that rises from the other end of the bottom surface and that is parallel to the axis of the forging tool.

16. The forging tool according to claim 13, wherein the first mating surface, the second mating surface, the first facing surface, and the second facing surface are inclined relative to a plane perpendicular to the direction of the load by an angle greater than or equal to 45° but not greater than 75°.

* * * * *